US006212343B1

(12) United States Patent
Hosokawa et al.

(10) Patent No.: US 6,212,343 B1
(45) Date of Patent: Apr. 3, 2001

(54) DEVELOPING DEVICE, PROCESS CARTRIDGE AND IMAGE FORMING APPARATUS THAT PREVENT TONER LEAKAGE

(75) Inventors: Hiroshi Hosokawa, Yokohama; Tetsuo Yamanaka, Tokyo; Kenetsu Osanai, Yokohama; Kenichiroh Nagai, Sagamihara, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/425,221

(22) Filed: Oct. 22, 1999

(30) Foreign Application Priority Data

| | | |
|---|---|---|
| Oct. 22, 1998 | (JP) | 10-301326 |
| Oct. 22, 1998 | (JP) | 10-301327 |
| Oct. 22, 1998 | (JP) | 10-301329 |
| Oct. 26, 1998 | (JP) | 10-303848 |
| Oct. 29, 1998 | (JP) | 10-308454 |
| Oct. 29, 1998 | (JP) | 10-308456 |
| Dec. 24, 1998 | (JP) | 10-367439 |
| Dec. 24, 1998 | (JP) | 10-367440 |
| Jun. 30, 1999 | (JP) | 11-184687 |

(51) Int. Cl.[7] ..... G03G 15/08
(52) U.S. Cl. ..... 399/102; 399/103
(58) Field of Search ..... 399/102, 103, 399/104, 105, 106, 111, 274

(56) References Cited

U.S. PATENT DOCUMENTS

| | | | |
|---|---|---|---|
| 5,212,521 | 5/1993 | Ogawa et al. . | |
| 5,489,747 | 2/1996 | Takenaka et al. . | |
| 5,552,870 | 9/1996 | Murakami et al. . | |
| 5,617,191 | 4/1997 | Murakami et al. . | |
| 5,625,438 | 4/1997 | Sugiyama et al. . | |
| 5,625,440 | 4/1997 | Matsumae et al. . | |
| 5,625,441 | 4/1997 | Sugiyama et al. . | |
| 5,627,630 | 5/1997 | Matsumae et al. . | |
| 5,666,625 | 9/1997 | Komatsubara et al. . | |
| 5,689,782 | 11/1997 | Murakami et al. . | |
| 5,697,026 | 12/1997 | Matsumae et al. . | |
| 5,708,942 | 1/1998 | Sugiyama et al. . | |
| 5,845,183 | 12/1998 | Sugiyama et al. . | |
| 5,879,752 | 3/1999 | Murakami et al. . | |
| 6,021,291 * | 2/2000 | Karakama et al. | 399/104 |

* cited by examiner

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

A developing device including a developing roller opposed to a photoconductor and rotatably mounted to a developing case of the developing device. A blade mounting surface is formed in an outer wall of the developing case, that is opposed to the photoconductor, and a blade holder, a blade and a supporting plate, that are laminated with each other, are mounted to the blade mounting surface of the developing case. A part of the blade opposite to a part of the blade sandwiched between the blade holder and the supporting member is elastically bent so as to contact an outer circumferential surface of the developing roller, and seal members are arranged at least along an edge of a longitudinal side of the blade holder at the side of the developing roller and along an edge of another longitudinal side of the blade holder at the opposite side of the developing roller, respectively, so as to increase airtightness of gaps between the blade holder and the outer wall of the developing case.

32 Claims, 17 Drawing Sheets

DEVELOPING DEVICE, PROCESS CARTRIDGE AND IMAGE FORMING APPARATUS THAT PREVENT TONER LEAKAGE

BACKGROUND OF THE INVENTION

1. Field of the Invention

The present invention relates to a developing device, a process cartridge in which a developing device and a photoconductor unit are integrated, and an image forming apparatus, and more particularly relates to an improved mechanism to prevent toner from leaking out of the developing device.

2. Discussion of the Background

There is known a developing device for developing an electrostatic latent image formed on a photoconductor in which a developing roller to supply toner to the photoconductor and a blade contacting a surface of the developing roller are mounted to a developing case containing toner therein. In such a developing device, the blade restricts the thickness of toner adhering to the developing roller. When single-component toner is used, the blade is pressed to contact the developing roller such that toner passing between the blade and the developing roller is charged by friction. When the blade is made of an elastically deformable metal plate the blade is fixed to the developing case and is pressed to the developing roller while being bent. In this case, because the rigidity of the blade is low, the blade is sandwiched between a blade holder with high rigidity and a supporting member so as to be laminated with each other, and the laminated blade, blade holder and supporting member are attached to the developing case.

If the developing device as described above is dropped during transportation, the developing roller and the blade vibrate and thereby toner intrudes into a gap between the backside of the blade and a blade attaching surface of the developing case and leaks out of the developing case. To prevent such leakage of toner, an opening of the developing case is sealed by a tape, which is peeled off when the developing device is used. This method of sealing an opening of a developing case with a tape requires an operation of taking off the seal when attaching the developing case to an image forming apparatus, which is troublesome.

In order to attach a blade made of a metal plate to a developing case, while laminating the blade with a long blade holder having high rigidity, a blade attaching surface corresponding to the long blade holder must be formed in the developing case. It is hard to form a blade attaching surface having a length corresponding to the long blade holder in a precise manner in the developing case. Generally, the blade attaching surface is formed partly uneven in the longitudinal direction and thereby the blade holder bends in the longitudinal direction together with the blade. Because of this bending of the blade holder and the blade, a contact line between the blade and the developing roller deviates from a line parallel to an axial line of the developing roller and thereby the contact pressure of the blade against the developing roller becomes uneven, causing an undesirable effect on the quality of a resulting image.

It may be conceivable to form protruding blade attaching surfaces in the vicinity of both ends of the developing case so as to support both ends of the blade holder, together with the blade, with the protruding blade attaching surfaces. However, the airtightness between the blade holder and the developing case is lost at the center part of the developing case, i.e., at a part between the blade attaching surfaces at both side ends of the developing case, and thereby toner tends to leak therefrom.

When a developing device is configured such that the amount of toner adhering to a developing roller is restricted by a blade, a roller part of the developing roller is disposed at a toner exit formed in a developing case and axial parts of the developing roller protruding from both ends of the roller part respectively are rotatably supported by supporting walls formed at both sides of the developing case. A lower edge of the blade contacts the roller part of the developing roller such that the blade seals a gap between an upper edge of the toner exit and an upper outer circumferential surface of the developing roller. Further, in order to prevent leakage of toner through a gap between an outer circumferential surface of the developing roller and the toner exit, side seals are provided at both longitudinal ends of the toner exit so as to contact outer circumferential surfaces of both ends of the roller part of the developing roller and an exit seal is provided at a flat surface of the developing case, which is formed in the developing case extending from a lower edge of the toner exit toward a photoconductor, so as to elastically contact the roller part of the developing roller.

In order to decrease the load to the developing roller when the developing roller is driven, the exit seal is generally formed with a thin plastic sheet having low compressibility and is configured such that a part of the exit seal is supported by the flat surface of the developing case and a free end part of the exit seal extending toward the toner exit from the flat surface is pressed against the outer circumferential surface of the developing roller by its own elasticity. The exit seal is generally stuck to the flat surface of the developing case by double-sided adhesive tape.

As described above, because the exit seal contacts the developing roller by its own elasticity and the part of the exit seal stuck to the flat surface of the developing case does not contact the developing roller, both ends of the exit seal tend to be peeled off. If both ends of the exit seal peel off, toner intruded under the exit seal intrudes toward both ends of the exit seal and may leak through a gap between the inner surfaces of the supporting walls formed at both sides of the developing case and the ends of the exit seal.

Further, in order to prevent leakage of toner through a gap between the outer circumferential surface of the developing roller and the toner exit, it is practiced that a free end side of an exit seal attached to a lower part of a developing case elastically contacts a lower outer circumferential surface of the developing roller and outer circumferential surfaces of both ends of a roller part of the developing roller are supported by side seals disposed at both longitudinal ends of the toner exit of the developing case.

When a blade is formed with a thin metal plate having elasticity and is configured such that the blade is bent by a developing roller so as to contact the developing roller by its reacting force when the blade is assembled in the developing device, as described above, the axial center of the developing roller is determined by a bearing of a developing case. In the above configuration, in order to bend the metal blade by pressure of the developing roller, the blade must be shorter than the interval between inner surfaces of side seals arranged at both sides of the developing roller. If the blade is made shorter than the interval between the inner surfaces of the side seals, a gap is generated between both ends of the blade and both inner surfaces of a toner exit, causing leakage of toner through the gap. If the blade is made longer than the interval between the inner surfaces of the side seals, the blade contacts the side seals due to pressure of the developing roller and thereby the blade cannot be bent any further. Such loss in the freedom of bending in the blade causes deformation of the blade and inferior sealing of a gap between the roller part of the developing roller and the side seals.

A known developing device includes a stirring device to stir toner in a developing case, a developing roller and a toner supplying roller to supply toner to the developing roller. In such a developing device, in order to transmit power to the toner stirring device and the toner supplying roller from the outside, rotation axes of these rotating devices protrude from a side wall of the developing case and gears are provided to ends of the protruded axes respectively to transmit rotation power to the axes.

In such a developing device, if sealing around the rotation axes of the stirring device and the toner supplying roller is insufficient, toner tends to leak out of the developing case around the rotation axes when the developing device falls and is shocked. The sealing effect around the rotation axes may be sufficiently increased by arranging a seal member having a rubber lip at respective inner circumferential parts of ring-shaped metal bearings supporting the rotation axes. However, the seal member having such a configuration is expensive and therefore increases the cost of a developing device using the sealing member.

In an image forming apparatus such as a copying machine or printer, it is widely practiced that a photoconductor unit, in which a photoconductor and a used toner collecting device to collect residual toner on an outer circumferential surface of the photoconductor are assembled in a body, and a developing device, in which a developing roller is provided to a developing case, are assembled to a unit known as a process cartridge.

FIGS. 19 and 20 illustrate an example of such a photoconductor unit. FIG. 19 is a side vertical cross section of a photoconductor unit 200. A photoconductor 9 is rotatably supported by the photoconductor unit 200 and a used toner collecting part 101 to collect used toner remaining on an outer circumferential surface of the photoconductor 9 is formed in the photoconductor unit 200.

FIG. 20 is a front view of the photoconductor unit 200 when the photoconductor 9 is removed. A collecting inlet 102 is formed in the used toner collecting part 101 at a position near an outer circumferential surface of the photoconductor 9. The collecting inlet 102 is formed in a long and narrow rectangular shape extending substantially over the entire length of the photoconductor 9. Side seals 103 formed with a teflon felt or the like are stuck at edges of both longitudinal sides of the collecting inlet 102. The side seals 103 slidably contact outer circumferential surfaces of both ends of the photoconductor 9.

A long blade 104 that scrapes off residual used toner on an outer circumferential surface of the photoconductor 9 is fixed to one longitudinal edge of the collecting inlet 102 and a long inlet seal 105 is stuck to the other longitudinal edge of the collecting inlet 102. The inlet seal 105 slidably contacts an outer circumferential surface of the photoconductor 9 so as to prevent used toner scraped off by the blade 104 from leaking through the collecting inlet 102. Both longitudinal ends of the inlet seal 105 contact the side seals 103 by pressure respectively.

The photoconductor 9 rotates in a direction indicated by an arrow in FIG. 19 and an electrostatic latent image is formed on an outer circumferential surface of the photoconductor 9 by exposure with a latent image forming part (not shown). The latent image is developed to a visible toner image with toner supplied by a developing roller (not shown), and the toner image is then transferred to a transfer sheet (not shown) at a transfer position. When the toner image is transferred to the transfer sheet, a part of the toner of the toner image is not transferred to the transfer sheet and remains on the outer circumferential surface of the photoconductor 9 as residual used toner. The residual toner is scraped off the outer circumferential surface of the photoconductor 9 with the blade 104 and is collected to the used toner collecting part 101. When collecting used toner, the inlet seal 105 slidably contacts the outer circumferential surface of the photoconductor 9 and thereby leakage of the collected used toner from the collecting inlet 102 is prevented. Also, leakage of toner from both sides of the inlet seal 105 is prevented by bringing both longitudinal ends of the inlet seal 105 into contact with the side seals 103 by pressure.

However, when the photoconductor 9 is rotated in the direction of the arrow in FIG. 19, a pulling force is applied to the inlet seal 105, which is slidably contacting the outer circumferential surface of the photoconductor 9, in the rotation direction of the photoconductor 9. The pulling force acts on both longitudinal ends of the inlet seal 105 in a direction to peel off the inlet seal 105 and thereby both ends of the inlet seal 105 are moved toward the center of the inlet seal 105 and thereby a part of the inlet seal 105 slidably contacting the outer circumferential surface of the photoconductor 9 waves. Because of this waving, a gap is created between the inlet seal 105 and the outer circumferential surface of the photoconductor 9 and collected used toner leaks through the gap.

Further, if a gap is created between the inlet seal 105 and the side seals 103, which are overlaid with each other, as a result of the both end parts of the inlet seal 105 being pulled toward the center of the inlet seal 105 as described above, collected used toner intrudes into the gap and the intruded toner leaks from the sides of the inlet seals 105.

SUMMARY OF THF INVENTION

The present invention has been made in view of the above-discussed and other problems and addresses and resolves the above-discussed and other problems. A preferred embodiment of the present invention provides a novel developing device, a novel process cartridge using the developing device and a novel image forming apparatus using the developing device or the process cartridge, in which leakage of toner from a developing case of the developing device is prevented without having inconvenience of taking off a tape sealing an opening of the developing case when using the developing device or the process cartridge.

Another preferred embodiment of the present invention provides a novel developing device, a novel process cartridge using the developing device and a novel image forming apparatus using the developing device or the process cartridge, in which a blade can be disposed so as to contact a developing roller straight, leakage of toner due to a drop of the developing device or the process cartridge is prevented, and inconvenience of taking off a tape sealing an opening of a developing case of the developing device is avoided.

Further, another preferred embodiment of the present invention provides a novel developing device, a novel process cartridge using the developing device and a novel image forming apparatus using the developing device or the process cartridge, in which leakage of toner from both sides of an exit seal of a developing case of the developing device is prevented.

Another preferred embodiment of the present invention provides a novel developing device, a novel process cartridge using the developing device and a novel image forming apparatus using the developing device or the process cartridge, in which leakage of toner from both sides of a developing roller and a blade is prevented.

Furthermore, another preferred embodiment of the present invention provides a novel developing device and a novel process cartridge using the developing device and a novel image forming apparatus using the developing device or the process cartridge with an inexpensive and simple configuration, in which toner is prevented from leaking out of a developing case of the developing device, at a part where rotation axes of a toner stirring device and a toner supplying roller provided in the developing case of the developing device pass through a side wall of the developing case, from around the rotation axes, and in which, even when toner leaks from around the rotation axes toward the outside of the developing case, scattering of the toner is prevented.

Another embodiment of the present invention provides a novel photoconductor unit, a novel process cartridge using the developing device and a novel image forming apparatus using the developing device or the photoconductor unit, in which, when residual toner on an outer circumferential surface of a photoconductor is collected to a used toner collecting part, leakage of the collected used toner is prevented.

According to an embodiment of the present invention, in a developing device, a developing roller opposed to a photoconductor is rotatably mounted to a developing case of the developing device. A blade mounting surface is formed in an outer wall of the developing case, that is opposed to the photoconductor, and a blade holder, a blade and a supporting plate, that are laminated with each other, are mounted to the blade mounting surface of the developing case. A part of the blade opposite to a part of the blade sandwiched between the blade holder and the supporting member is elastically bent so as to contact an outer circumferential surface of the developing roller, and seal members are arranged at least along an edge of a longitudinal side of the blade holder at the side of the developing roller and along an edge of another longitudinal side of the blade holder at the opposite side of the developing roller, respectively, so as to increase airtightness of gaps between the blade holder and the outer wall of the developing case.

The seal members may be made longer than a longitudinal length of the blade holder, so that both longitudinal ends of the seal members are bent along sides of both ends of the blade holder, respectively.

According to another embodiment of the present invention, in a developing device, blade mounting surfaces and a recessed surface are formed in an outer wall of the developing case, that is opposed to the photoconductor, in vicinity of both longitudinal ends and at a center part of the outer wall, respectively, and a surface of the recessed surface is recessed from surfaces of the blade mounting surfaces. A blade holder, a blade and a supporting plate, that are laminated with each other, are mounted to the blade mounting surfaces, and a part of the blade opposite to a part of the blade sandwiched between the blade holder and the supporting member is elastically bent so as to contact an outer circumferential surface of the developing roller. Seal members are arranged at least along an edge of a longitudinal side of the blade holder at the side of the developing roller and along an edge of another longitudinal side of the blade holder at the opposite side of the developing roller, respectively, so as to increase airtightness of gaps between the blade holder and the outer wall of the developing case, and a packing member is arranged in a gap between the center part of the blade holder and the recessed part.

The seal members may be formed with a material that has a density finer than that of toner particles and a rigidity that will not cause any deformation of the blade.

According to still another embodiment of the present invention, a developing device includes a developing case in which a toner exit opposed to a photoconductor and a flat surface extended from a lower edge of the toner exit toward the photoconductor are formed. A developing roller includes an axial part rotatably supported by supporting walls provided at both sides of the developing case and a roller part disposed at the toner exit. A blade is configured such that a lower edge thereof contacts the roller part of the developing roller so as to seal a gap between an upper edge of the toner exit and an upper outer circumferential surface of the roller part of the developing roller. A thin exit seal is supported by the flat surface of the developing case with a free end side thereof, which is extended toward the inside of the toner exit, elastically contacting the roller part of the developing roller, and corner seals seal corners where edges of longitudinal ends of the exit seal and the supporting walls of the developing case contact each other, respectively.

According to still another embodiment of the present invention, a developing device includes a developing case in which a toner exit opposed to a photoconductor and a flat surface extended from a lower edge of the toner exit toward the photoconductor are formed. A developing roller includes an axial part rotatably supported by supporting walls provided at both sides of the developing case and a roller part disposed at the toner exit. A blade is configured such that a lower edge thereof contacts the roller part of the developing roller so as to seal a gap between an upper edge of the toner exit and an upper outer circumferential surface of the roller part of the developing roller. A thin exit seal is supported by the flat surface of the developing case with a free end side thereof, which is extended toward the inside of the toner exit, elastically contacting the roller part of the developing roller, and clips elastically sandwich longitudinal ends of the exit seal and the flat surface of the developing case, respectively.

According to still another embodiment of the present invention, a developing device includes a developing case, in which a toner exit opposed to a photoconductor and a flat surface extended from a lower edge of the toner exit toward the photoconductor are formed, and a developing roller including an axial part rotatably supported by supporting walls provided at both sides of the developing case and a roller part disposed at the toner exit. A blade is configured such that a lower edge thereof contacts the roller part of the developing roller so as to seal a gap between an upper edge of the toner exit and an upper outer circumferential surface of the roller part of the developing roller. A thin exit seal is supported by the flat surface of the developing case with a free end side thereof, which is extended toward the inside of the toner exit, elastically contacting the roller part of the developing roller. Corner seals seal corners where longitudinal ends of the exit seal and the supporting walls of the developing case contact each other, respectively, and clips elastically sandwich longitudinal ends of the exit seal and the flat surface of the developing cover, respectively.

According to still another embodiment of the present invention, a developing device includes a developing case, in which a toner exit opposed to a photoconductor is formed, and a developing roller including an axial part rotatably supported by supporting walls provided at both sides of the developing case and a roller part disposed at the toner exit. Side seals are arranged at both longitudinal ends of the toner exit so as to contact outer circumferential surfaces of longitudinal ends of the roller part of the developing roller. A blade that is formed with a thin metal plate having elasticity is configured such that a lower edge thereof contacts the roller part of the developing roller so as to seal a gap between an upper edge of the toner exit and an upper outer circumferential surface of the roller part of the developing roller. The blade includes a wide-width part having a length such that both longitudinal ends thereof face the side seals respectively and a narrow-width part extended from the wide-width part toward upstream of a rotation direction of the developing roller and configured to have a length that enables the narrow-width part to be bent in a direction orthogonal to a longitudinal direction of the developing roller between the side seals arranged at both sides of the toner exit, and a step part forming a boundary between the wide-width part and the narrow-width part is disposed downstream of a contact point of the blade and the roller part of the developing roller in the rotation direction of the developing roller.

The length of the narrow-wide part may be made longer than an interval between inside surfaces of the side seals such that, when the blade is pressed by the developing roller, the narrow-wide part bends toward a rear side of the toner exit by pressure of the developing roller even after the wide-width part contacts the side seals.

According to still another embodiment of the present invention, in a developing device, a toner accommodating part is formed in a developing case of the developing device and a rotating member is rotatably housed in the toner accommodating part. A rotating axis of the rotating member passes through a wall of the developing case to protrude outside of the wall of the developing case and a flexible stopping claw formed at an end of the rotating axis protruded outside of the wall of the developing case is inserted into an insertion hole formed in a gear and is stopped by being engaged with the gear. A seal is stuck to an outside surface of the gear so as to seal the insertion hole.

According to still another embodiment of the present invention, in a developing device, a toner accommodating part is formed in a developing case of the developing device and a rotating member is rotatably housed in the toner accommodating part. A rotating axis of the rotating member passes through a wall of the developing case to protrude outside of the wall of the developing case and an end of the rotating axis protruded outside of the wall of the developing case is engaged with a gear. An engaging hole is formed in the wall of the developing case, a bearing is fit into the engaging hole, a bearing seal formed with foaming polyurethane in a donut shape so as to pass through the rotating axis is fixed to an end of the bearing facing the toner accommodating part. An outer diameter of the bearing seal is larger than an inner diameter of the engaging hole by about 0.2–1.0 mm in the radius.

According to still another embodiment of the present invention, in a developing device, a toner accommodating part is formed in a developing case of the developing device and a rotating member is rotatably housed in the toner accommodating part. A rotating axis of the rotating member passes through a wall of the developing case to protrude outside of the wall of the developing case and an end of the rotating axis protruded outside of the wall of the developing case is engaged with a gear. An engaging hole is formed in the wall of the developing case, a bearing is fit into the engaging hole, a bearing seal formed with foaming polyurethane in a donut shape so as to pass through the rotating axis is fixed to an end of the bearing facing the toner accommodating part. An inner diameter of the bearing seal is smaller than an inner diameter of the bearing by about 0.2–1.0 mm in the radius.

In the immediately above developing device, a D-shaped part may be formed at a part of the rotating axis engaging with the gear and a chamfer may be formed between a part of the rotating member where the D-shaped part is formed and a part of the rotating member where the D-shaped part is not formed.

According to still another embodiment of the present invention, in a photoconductor unit, a photoconductor is rotatably supported and a used toner collecting unit to collect residual used toner on the photoconductor is formed. A narrow and long collecting inlet is formed in the used toner collecting unit at a position adjacent to an outer circumferential surface of the photoconductor, extending along substantially an entire length of the photoconductor. Side seals are disposed at longitudinal ends of the collecting inlet so as to slidably contact an outer circumferential surface of ends of the photoconductor. A long blade is provided at one longitudinal edge of the collecting inlet so as to scrape off residual used toner on an outer circumferential surface of the photoconductor, and a long inlet seal is stuck to the other longitudinal edge of the collecting inlet so as to slidably contact the outer circumferential surface of the photoconductor. Support parts are formed at longitudinal ends of the inlet seal protruding in a direction orthogonal to a longitudinal direction of the inlet seal to increase a sticking area of the inlet seal to the edge of the collecting inlet.

Both longitudinal ends of the inlet seal may be overlaid with the side seals with respective outer edges of the inlet seal and the side seals aligned with each other, and pressing seals that are formed in a substantially L-shape with a fixing part and a leakage preventing part may be disposed such that the fixing part of the pressing seals is stuck on end parts of the inlet seal and the leakage preventing part is stuck at a position to contact outer end surfaces of the side seals and the inlet seal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 8B:
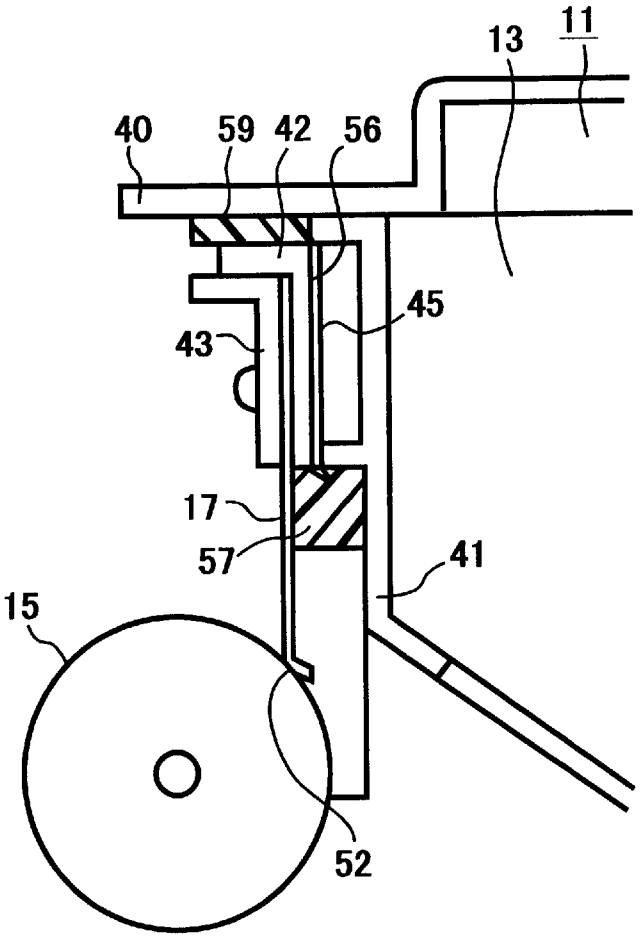
FIG. 8(*a*) and FIG. 8(*b*) are schematic drawings illustrating a support structure of the blade and seal members, FIG.
Figure 8A:
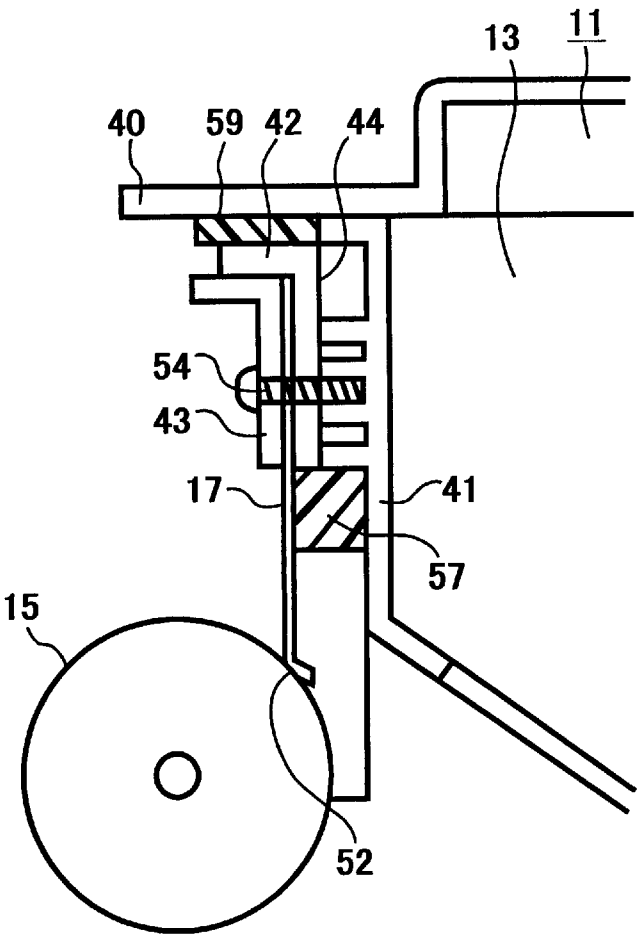
Figure 9:
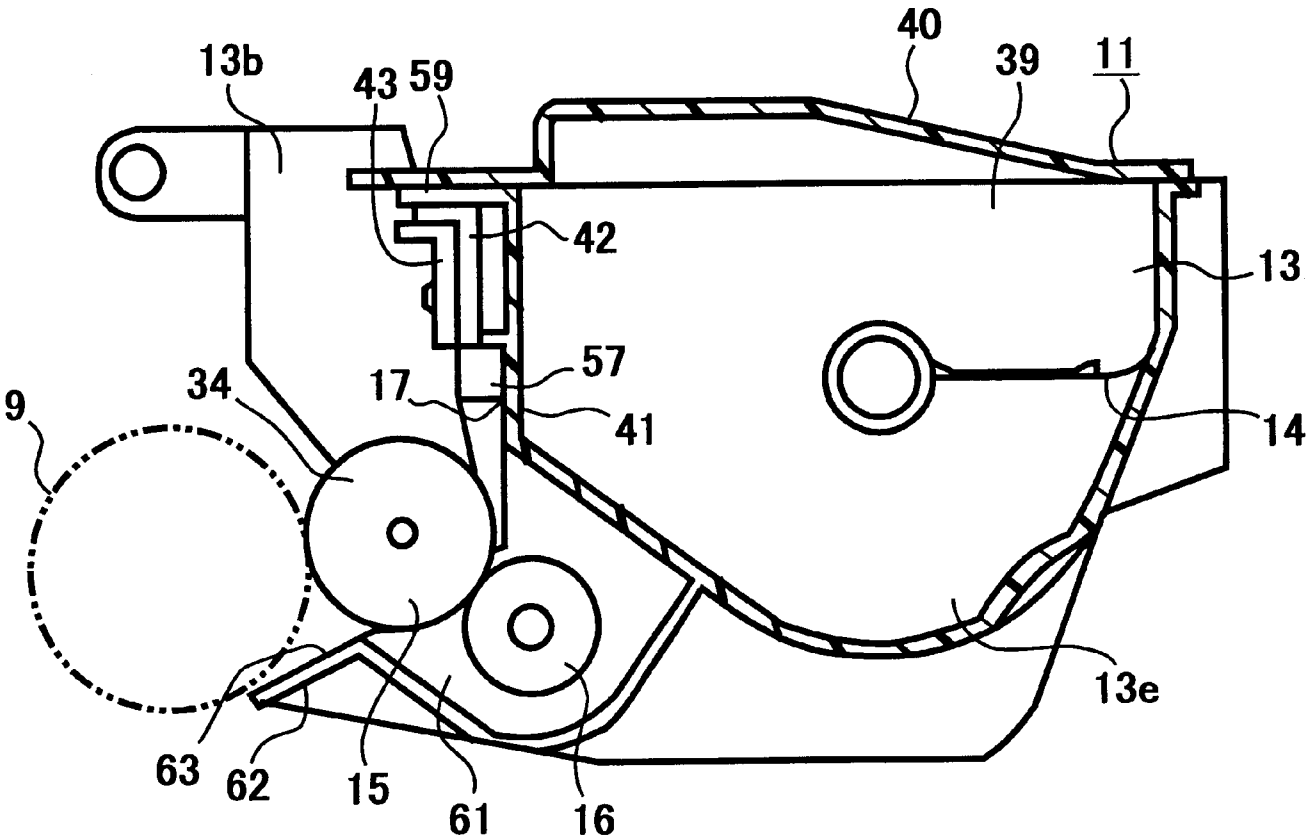
Figure 10:
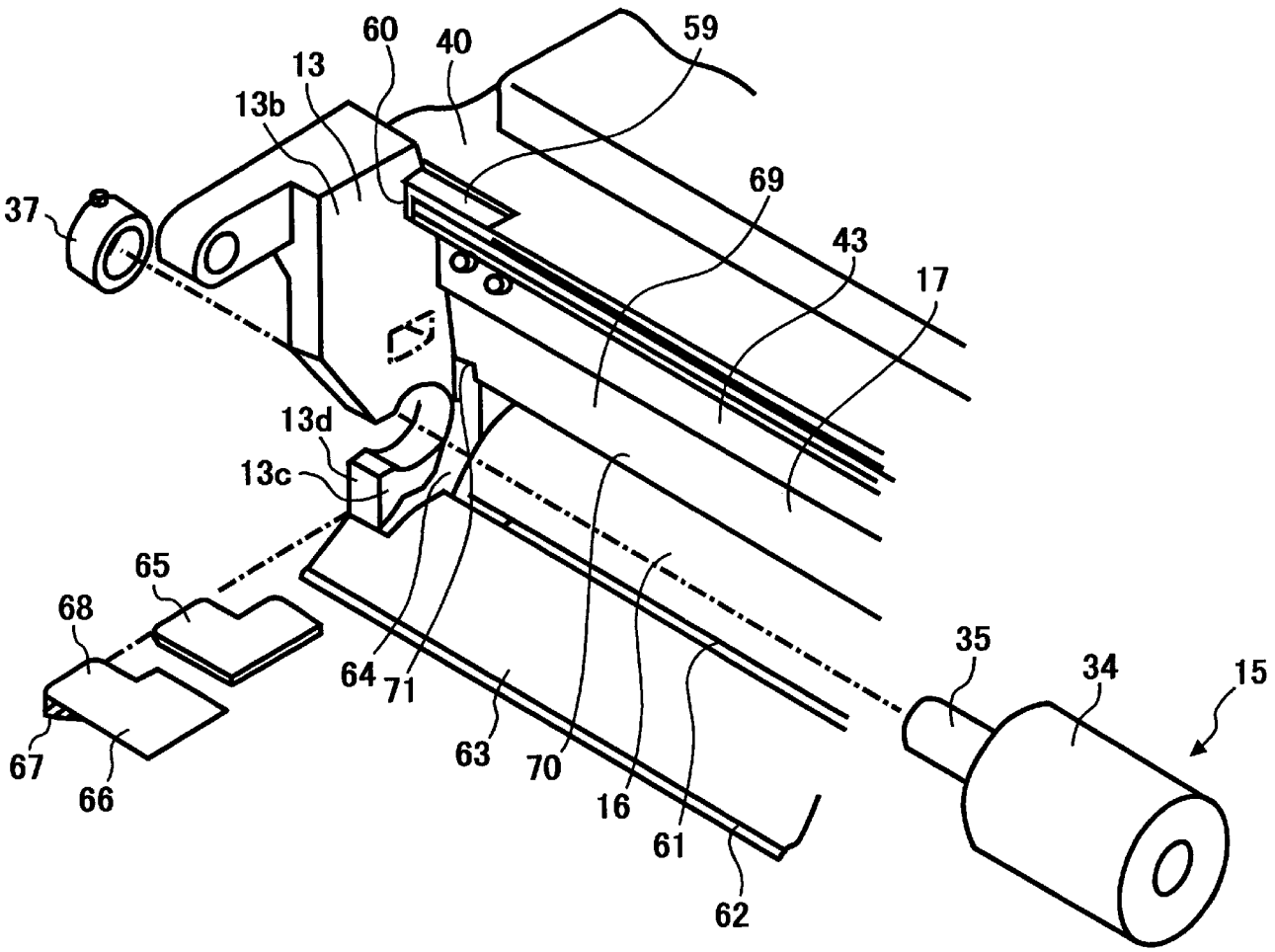
Figure 11:
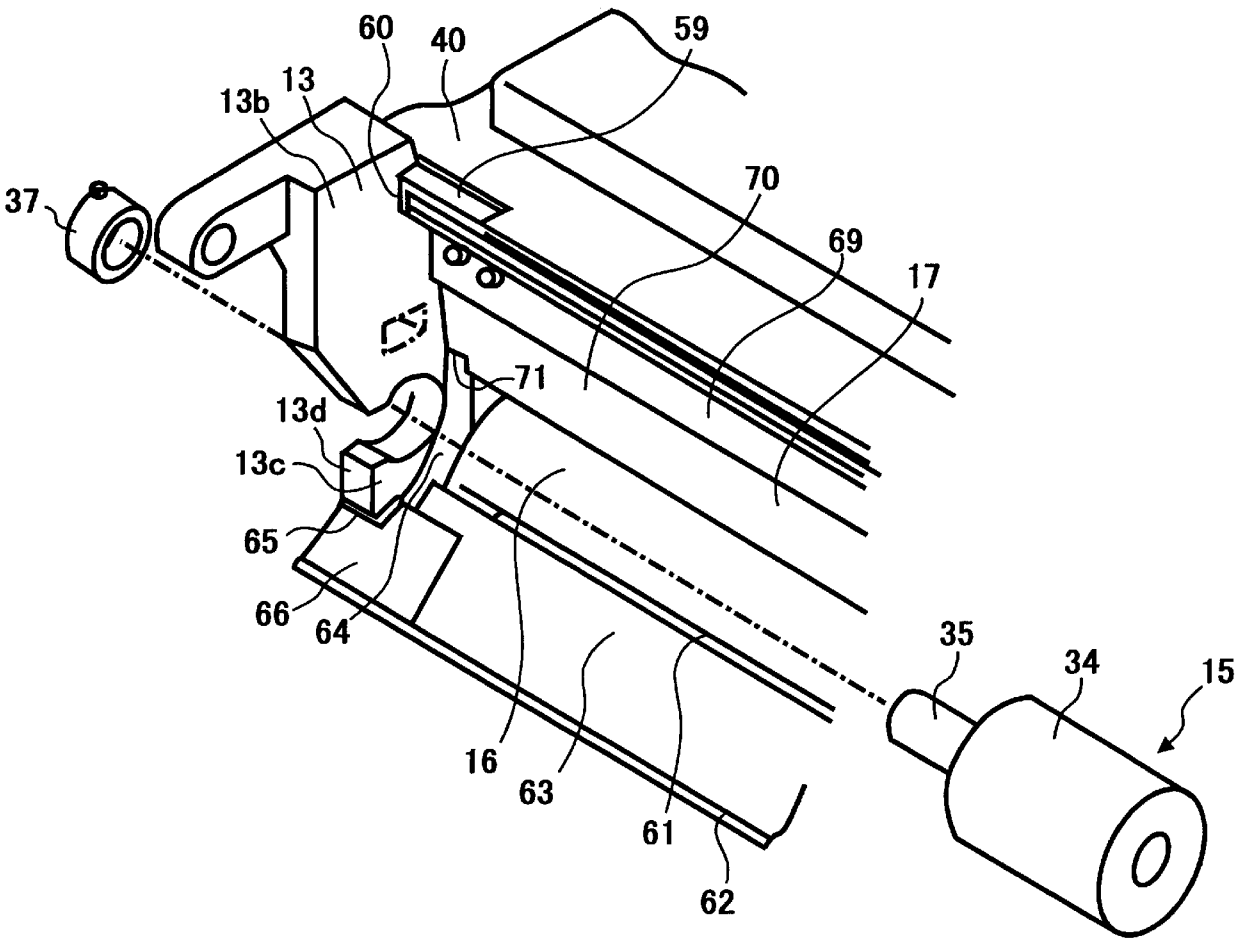
Figure 12:
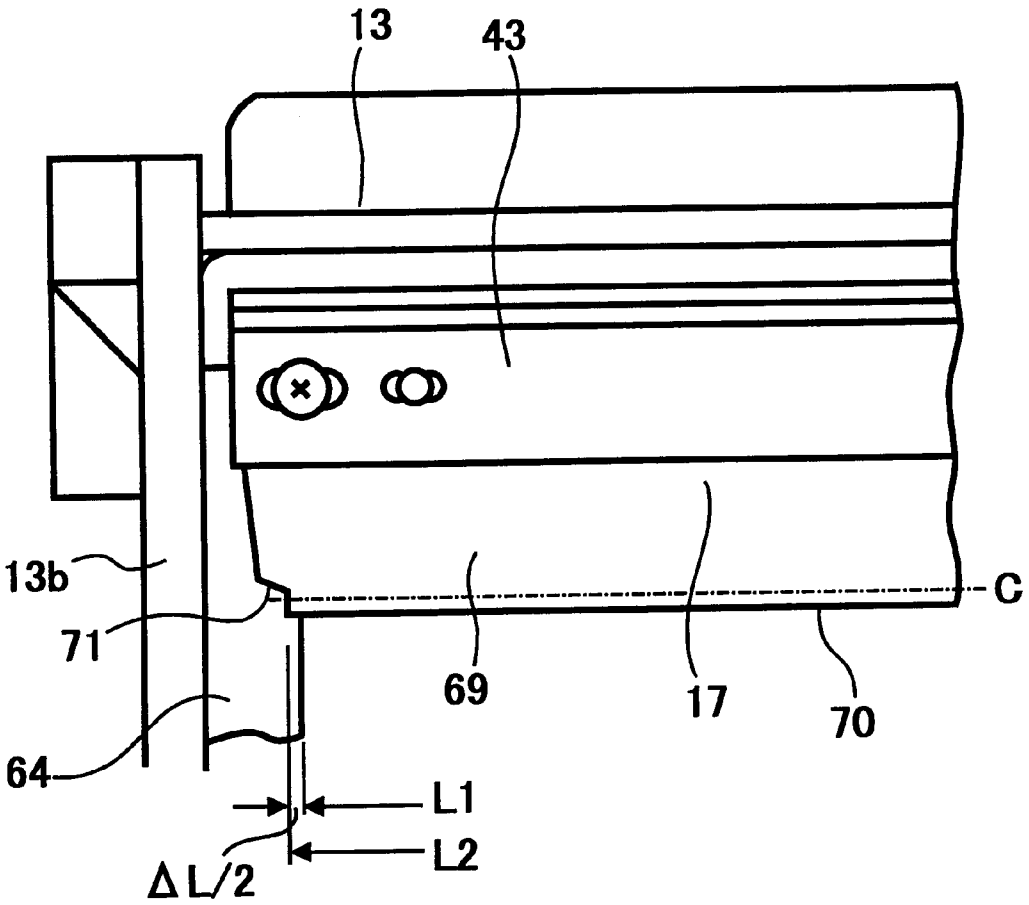
Figure 13:
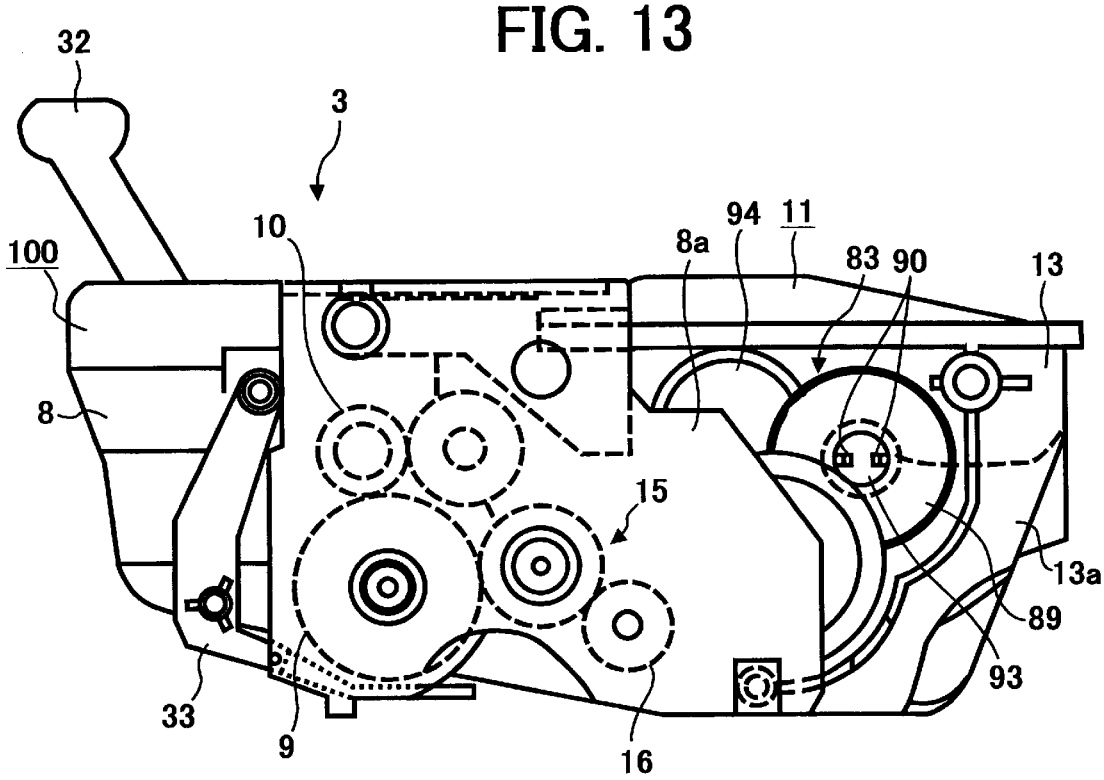
Figure 14:
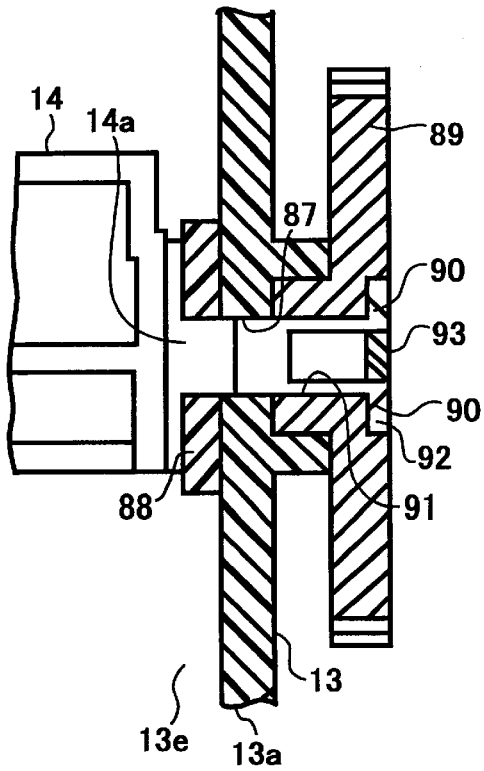
Figure 15:
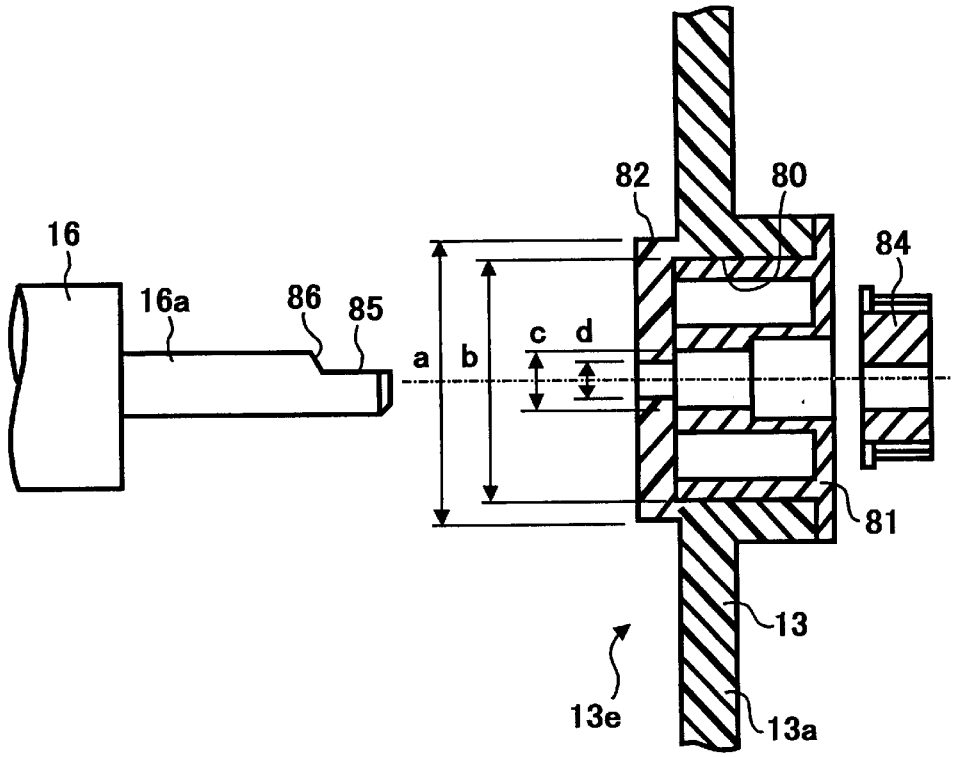
Figure 16:
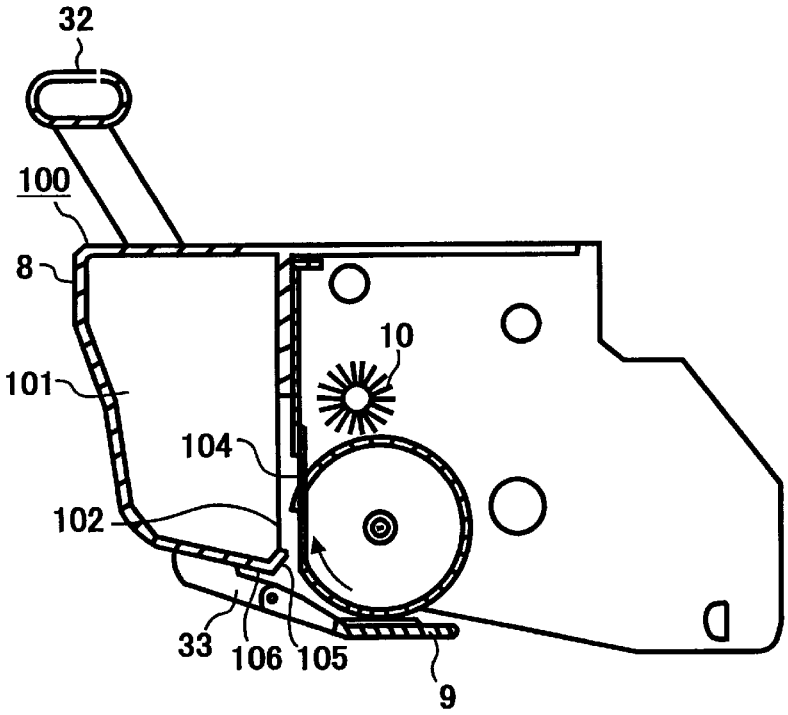
Figure 17:
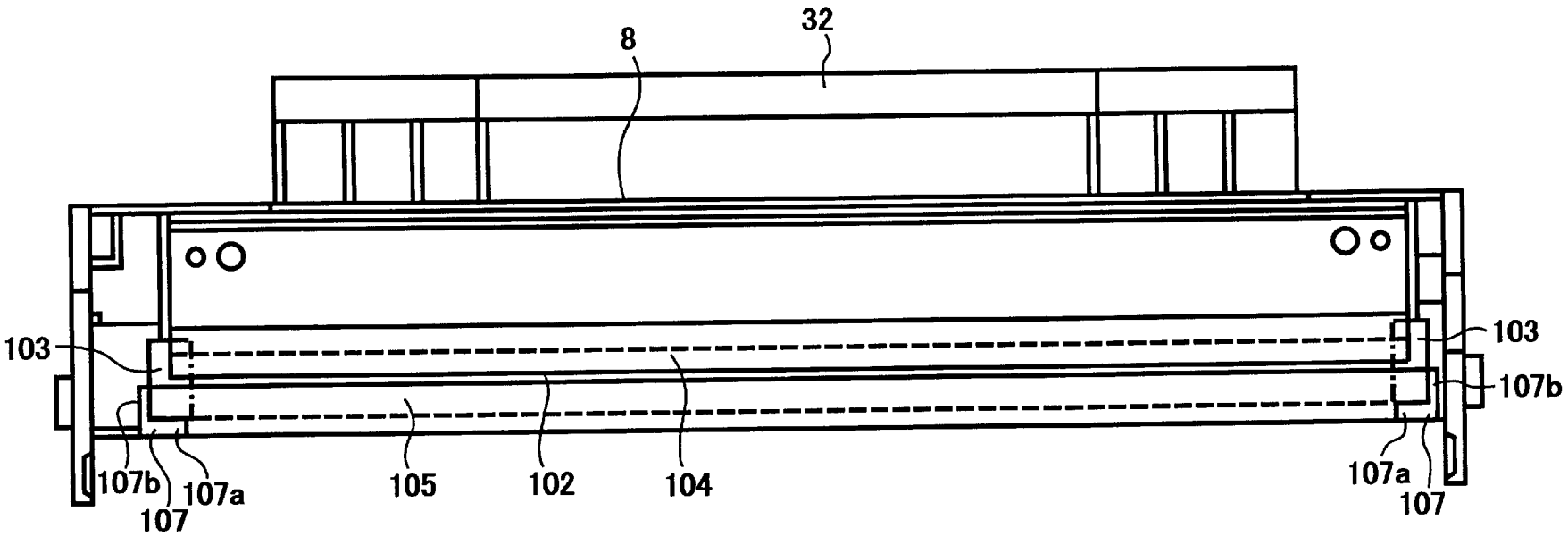
Figure 18:
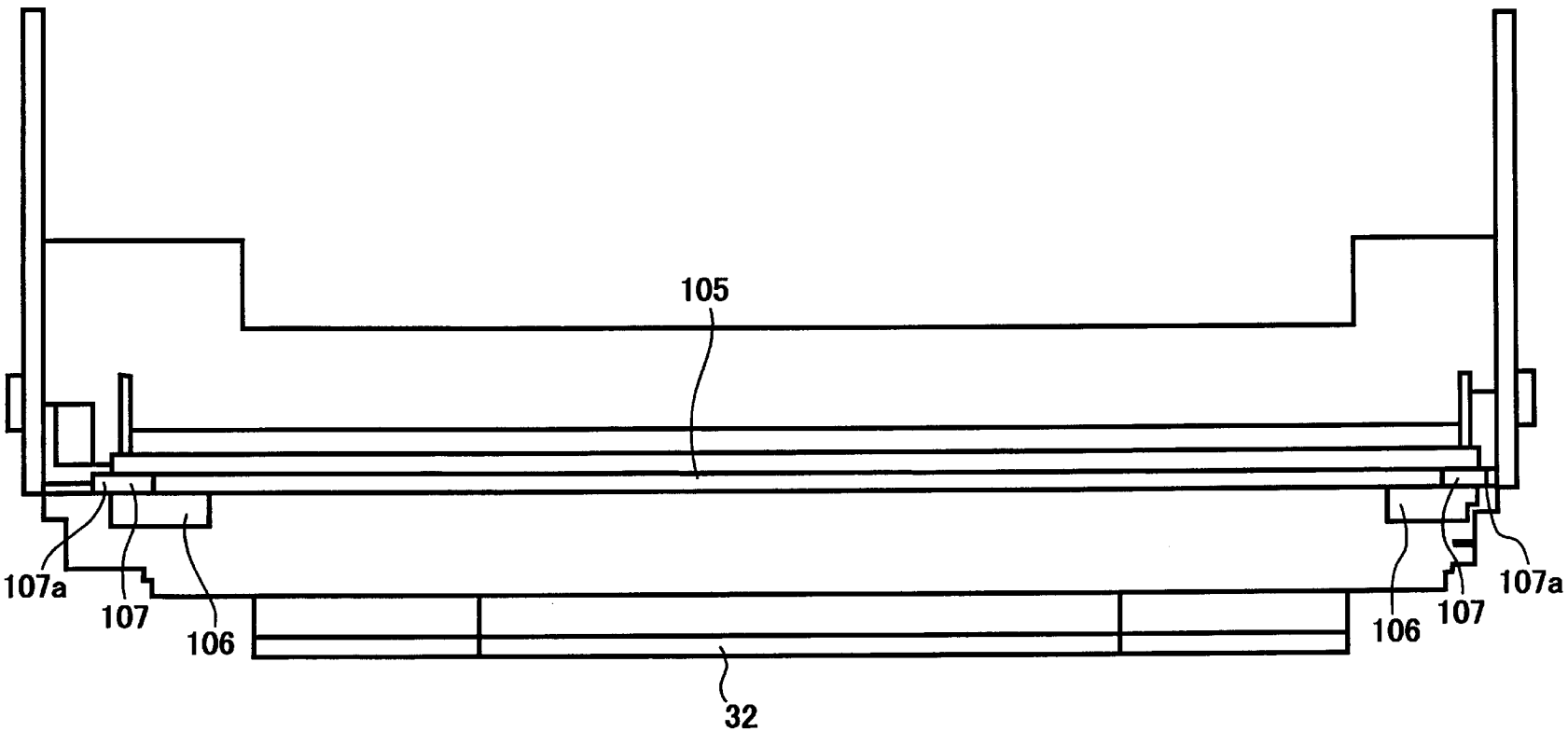
Figure 19:
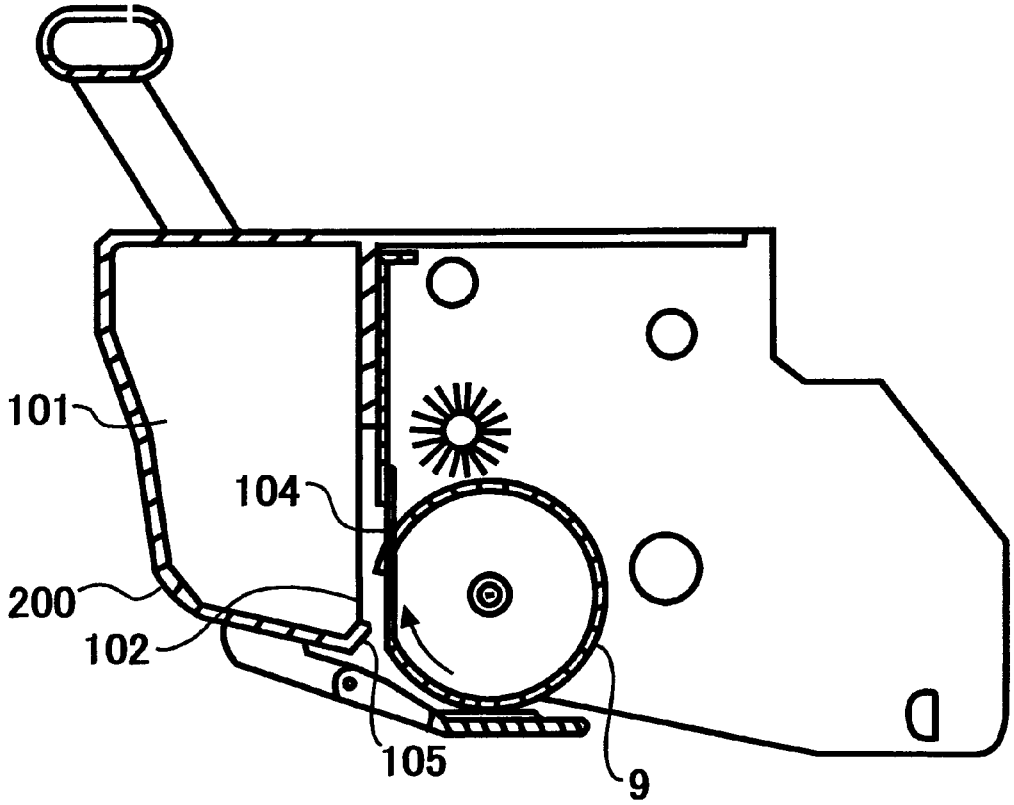
FIG. 19 RELATED ART

8(*a*) being a cross section at an end of the developing case and FIG. 8(*b*) being a cross section at a center of the developing case;

FIG. 9 is a side cross section of a process cartridge according to another embodiment of the present invention;

FIG. 10 is a schematic drawing illustrating an exemplary structure of mounting an exit seal and a corner seal to a developing case;

FIG. 11 is a schematic drawing illustrating a state where the exit seal and the corner seal are mounted to the developing case;

FIG. 12 is a front view of the developing case illustrating a relation between the blade and the side seal;

FIG. 13 is a side view of a process cartridge according to another embodiment of the present invention;

FIG. 14 is a front cross section illustrating an exemplary structure of attaching a toner stirring device to the developing case;

FIG. 15 is a front cross section illustrating an exemplary construction of attaching a toner supply roller to the developing device;

FIG. 16 is a side cross section of a photoconductor unit according to another embodiment of the present invention;

FIG. 17 is a front view of the photoconductor unit when a photoconductor is removed;

FIG. 18 is a bottom view of the photoconductor unit, illustrating a shape of a support part formed in an inlet seal and a position of sticking the inlet seal;

FIG. 19 is a side cross section of a photoconductor unit of a prior art; and

Figure 20:
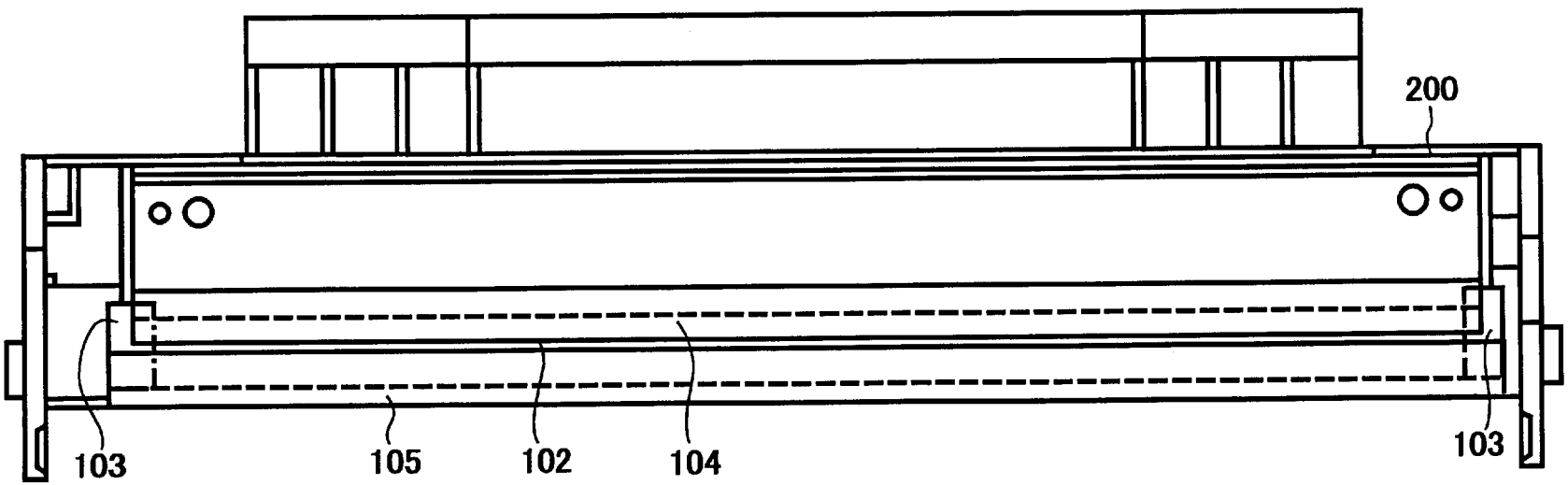
FIG. 20 RELATED ART

FIG. 20 is a front view of the photoconductor unit when a photoconductor is removed.

DESCRIPTION OF THE PREFERRED EMBODIMENTS

Referring now to the drawings, wherein like reference numerals designate identical or corresponding parts throughout the several views.

Referring now to the drawings, wherein like reference numerals designate identical or corresponding parts throughout the several views, the preferred embodiments of the present invention are described.

Figure 1:
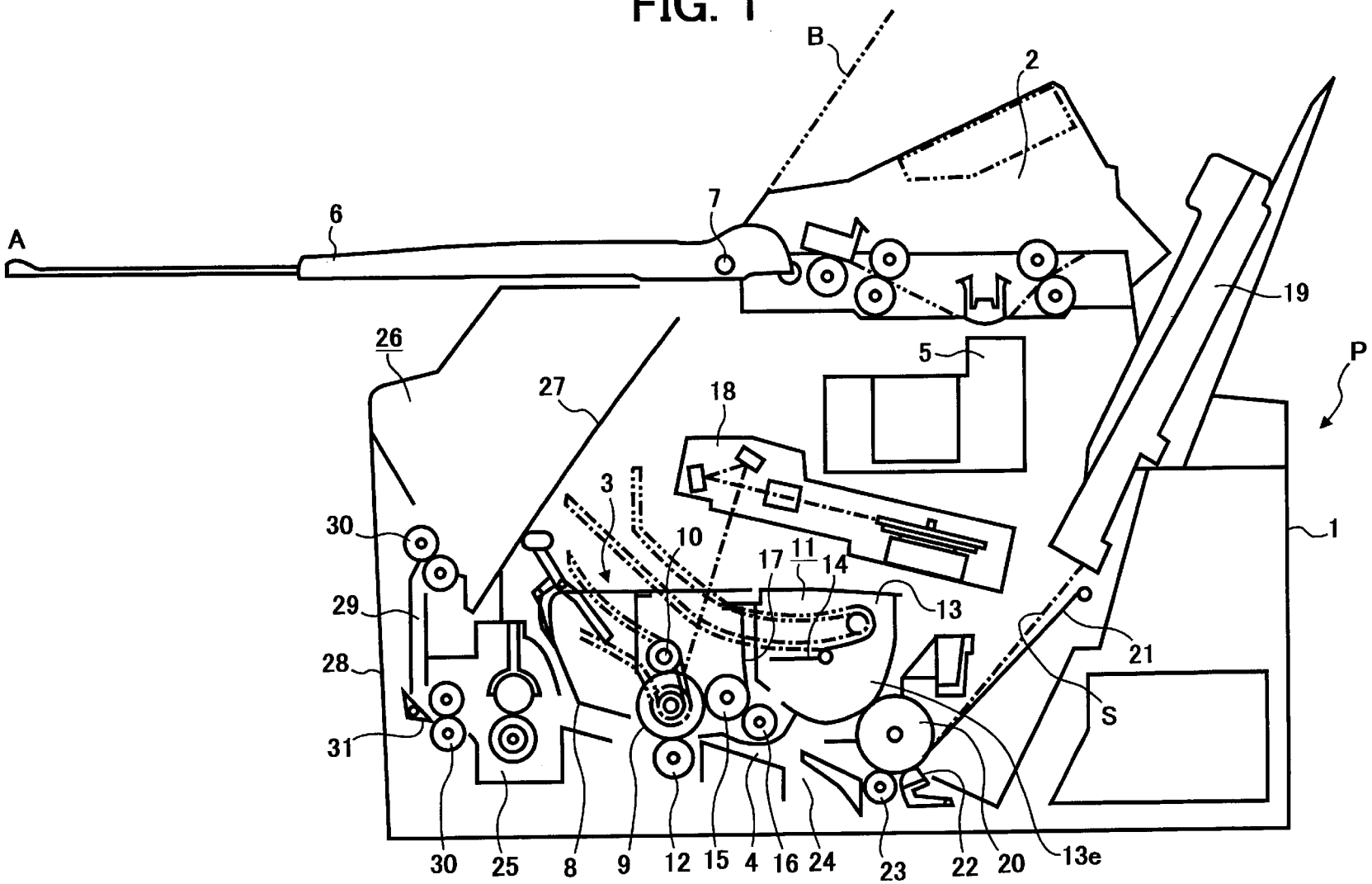
FIG. 1 is a side cross section illustrating an exemplary construction of an image forming apparatus having a process cartridge according to an embodiment of the present invention.

Referring more particularly to FIG. 1, an exemplary construction of an image forming apparatus P incorporating a process cartridge according to the first embodiment of the present invention is first described.

Numeral 1 denotes a main body of the image forming apparatus P. An image reading device 2 is provided at an upper part of the main body 1 to read an image of an original document, and a process cartridge 3 is provided inside the main body 1. A sheet conveying path 4 for guiding a transfer sheet is formed below the process cartridge 3.

The image reading device 2 includes a reading unit 5 that reads an image of an original document and an original document tray 6 that accommodates original documents to be fed toward the reading unit 5. The original document tray 6 is supported at a support axis 7 so as to be rotatable from a horizontal position A indicated by a solid line to a standing position B indicated by a two-dot chain line. The original document tray 6 is configured so as to be kept in a stable condition by stoppers (not shown) at the horizontal position A and the standing position B, respectively.

The process cartridge 3 includes a photoconductor case 8 which is formed in a shape of a case, a photoconductor 9, a charging roller 10 and a developing device 11. The photoconductor 9 is rotatably mounted to the photoconductor case 8. The charging roller 10 and the developing device 11 are arranged around the photoconductor 9. A transfer unit 12 is provided at the side of the main body 1 so as to face a circumferential surface of a lower part of the photoconductor 9. The developing device 11 includes a developing case 13 that is detachably attached to the photoconductor case 8, a rotatable developer stirring device 14 that stirs developer contained inside the developing case 13, i.e., inside a toner container unit 13*e*, a developing roller 15 contacting the photoconductor 9, a toner supply roller 16 that supplies developer to the developing roller 15, and a blade 17 contacting the developing roller 15. In addition, a latent image forming unit 18 is provided above the process cartridge 3 to form a latent image on the photoconductor 9 by scanning a charged part of the photoconductor 9 with a laser light modulated according to an image signal.

At one side of the main body 1, a tray 19 is provided to support a transfer sheet S in a slanted condition. The tray 19 also supports original documents which are read by the image reading device 2 and fed out therefrom. Below the tray 19, a feeding roller 20 that is rotatably driven and a pressure plate 21 that is pressed to one direction such that a transfer sheet S on the tray 19 is pressed to the feeding roller 20 are provided. Further, a separating pad 22 and a separating roller 23 are provided so as to elastically contact the feeding roller 20, respectively, such that double feeding of transfer sheets S is prevented.

The feeding roller 20, the separating pad 22 and the separating roller 23 are arranged at the entrance side of the sheet conveying path 4. A bottom path 24 is provided downstream of the conveying roller 20 in a direction in which a transfer sheet S is conveyed so as to communicate with the sheet conveying path 4. Further, a fixing unit 25 is arranged downstream of the sheet conveying path 4 to fix a toner image on a transfer sheet S.

A sheet stacker 26 is arranged between the original document tray 6 and the fixing unit 25. The stacker 26 includes a sheet receiving plate 27 that is positioned to align with a line extending from a lower end of the original document tray 6 when the original document tray 6 is rotated to the standing position B so as to receive a transfer sheet S exited from the fixing unit 25. A discharging exit 28 that discharges a transfer sheet S, which is exited from the fixing unit 25, in a horizontal direction and a reversed discharging path 29 that reverses and guides a transfer sheet S to the stacker 26 are provided in the vicinity of a side surface of the main body 1, which is opposite to the side where the tray 19 is provided. A pair of rollers 30 is provided at each of upper and lower end parts of the reversed discharging path 29. A switching claw 31 is rotatably arranged at a dividing point of the reversed discharging path 29 and the discharging exit 28 so as to switch the direction of discharging a transfer sheet S.

Next, the operation of reading an image of an original document and the operation of recording the image on a transfer sheet S are described. When reading an image of an original document, the original document is fed to the reading unit 5 while the original document tray 6 is kept in the horizontal position A as indicated by the solid line in FIG. 1. The image of the original document thus fed to the reading unit 5 is read by the reading unit 5, and then the original document is supported by an upper part of the tray 19 while being stood against the tray 19. The image thus read is transmitted to an external facsimile equipment when the image forming apparatus P is operated in a facsimile transmission mode or recorded on a transfer sheet S fed from the tray 19 when operated in a copying mode. The image forming apparatus P can also record an image received from the outside on a transfer sheet S in a facsimile reception mode.

When recording an image on a transfer sheet S, the surface of the photoconductor 9 is charged by the charging roller 10 while the photoconductor 9 is rotated in the clockwise direction, and an electrostatic latent image is formed on a charged part of the photoconductor 9 by the latent image forming unit 18 according to an image of an original document read by the image reading device 5 or an image received from the outside. The latent image is then developed with the developing device 11. The developed image is then transferred to a transfer sheet S, which is fed from the tray 19 by the feeding roller 20. The image transferred to the transfer sheet S is fixed to the sheet S when the sheet S passes through the fixing unit 25. The transfer sheet S carrying the image is then discharged to either the discharging exit 28 or the sheet stacker 26 according to the direction of the switching claw 31.

Figure 2:
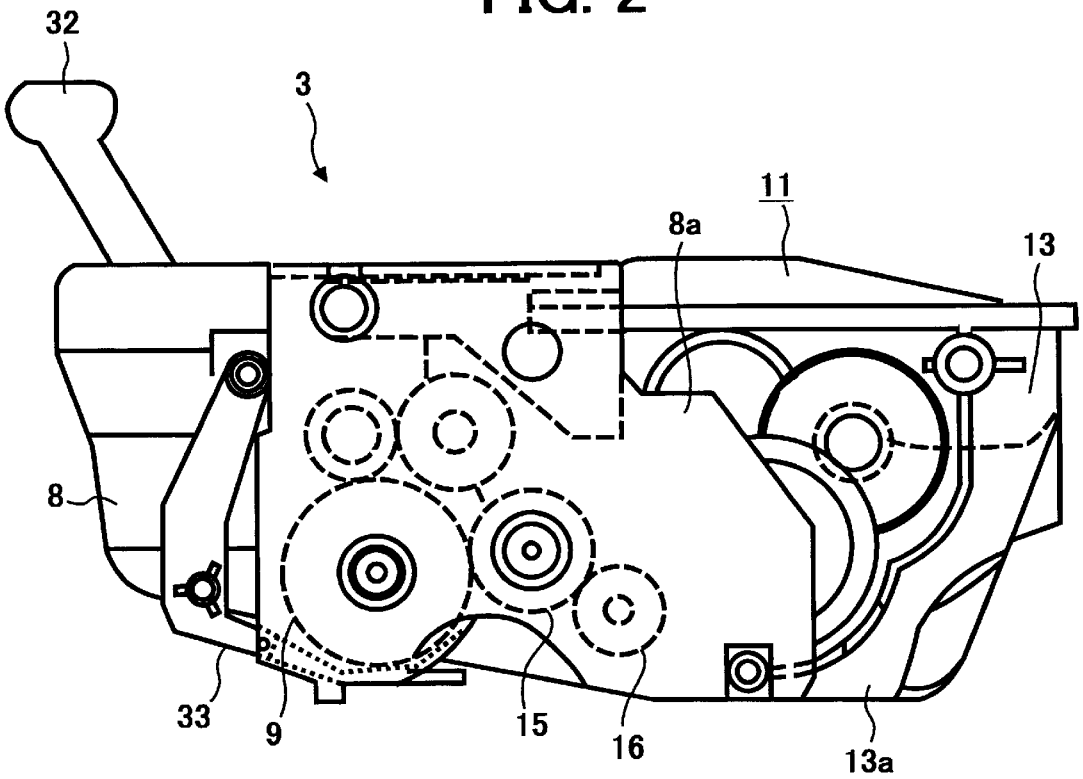
FIG. 2 is a side view of the process cartridge.

Next, the construction of the process cartridge 3, in particular, that of the developing device 11, is described. As illustrated in FIG. 2, the photoconductor case 8 includes a handle 32 to hold when attaching the process cartridge 3 to the main body 1 (FIG. 1). A shutter 33 is configured so as to cover the bottom surface of the photoconductor 9 when the process cartridge 3 is detached from the main body 1 and open the bottom surface of the photoconductor 9 when the process cartridge 3 is attached to the main body 1. The developing case 13 is detachably mounted between outer walls 8*a* and 8*b* at both sides of the photoconductor case 8. The wall 8*b* is not shown in FIG. 2 and is illustrated in FIG. 4.

Figure 3:
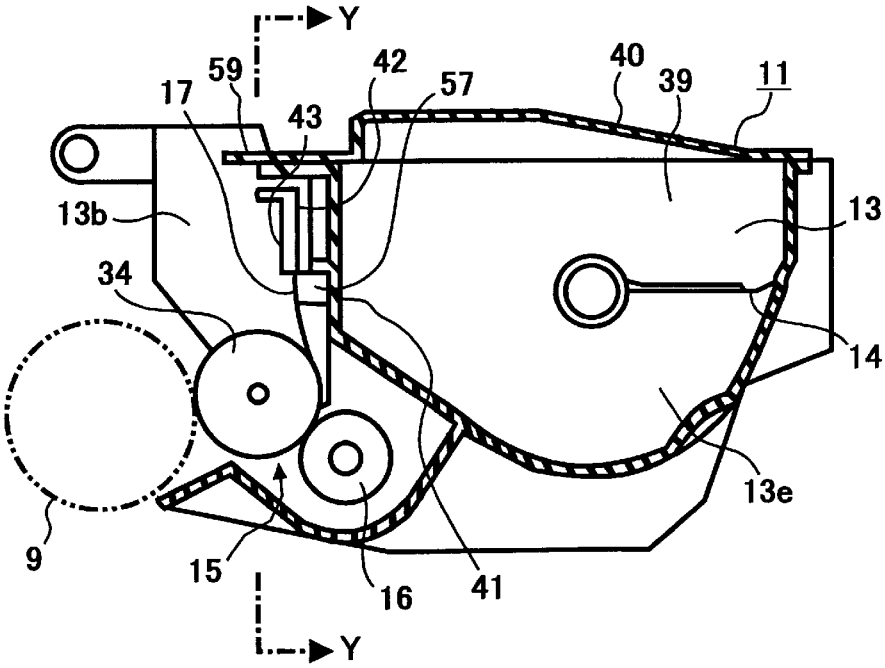
FIG. 3 is a side cross section of the process cartridge.
Figure 4:
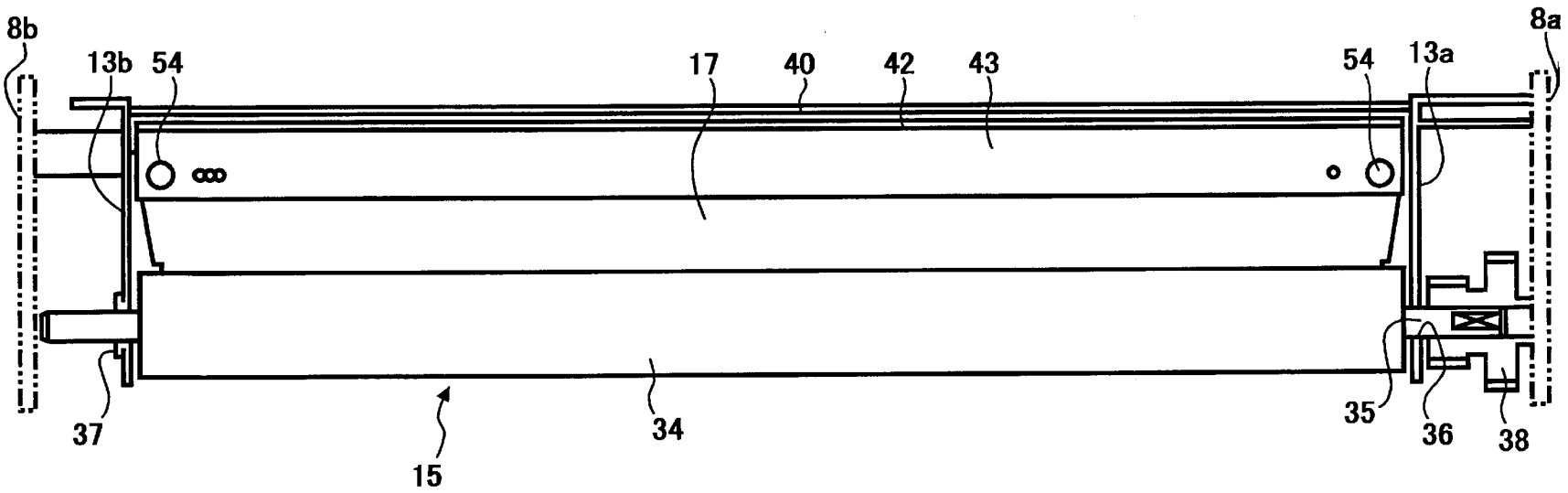
FIG. 4 is a front cross section of the process cartridge at a Y—Y line of FIG. 3.

FIG. 3 is a side vertical cross section of the developing device 11 and FIG. 4 is a front vertical cross section of the developing device 11 at a Y—Y line in FIG. 3. As illustrated in FIG. 4, the developing roller 15 includes a roller part 34 and a metal axial part 35 passing through the center of the roller part 34. The outer circumferential part of the roller part 34 is formed of an elastic material having a low friction coefficient, such as rubber, for charging single component toner by friction. The developing case 13, which is detachably mounted between the outer walls 8*a* and 8*b*, includes supporting walls 13*a* and 13*b* that face each other at a predetermined interval, inside the outer walls 8*a* and 8*b*. A bearing 36 is formed by opening a hole in the supporting wall 13*a* to rotatably support one end of the axial part 35 and a bearing 37 is formed by mounting a bushing in the supporting walls 13*b*. A plastic gear 38 that is driven by a motor (not shown) is engaged with an end of the axial part 35 protruding from the bearing 36.

As illustrated in FIG. 3, the developing case 13 is provided with a cover 40 that is adhered to an upper opening of a toner containing room 39. Further, a blade holder 42, a blade 17 and a support member or plate 43, that are laminated with each other, are attached to an outer wall 41 of the developing case 13 at the side of the photoconductor 9. The blade holder 42 has a relatively high rigidity and the blade 17 is formed with a metal plate that is elastically deformable, such as stainless steel. The blade 17 is sandwiched by the blade holder 42 and the support plate 43 at the upper half part of the blade 17, and the lower half part of the blade 17 extends downward from the laminated part so as to contact the developing roller 15 with pressure.

Figure 5:
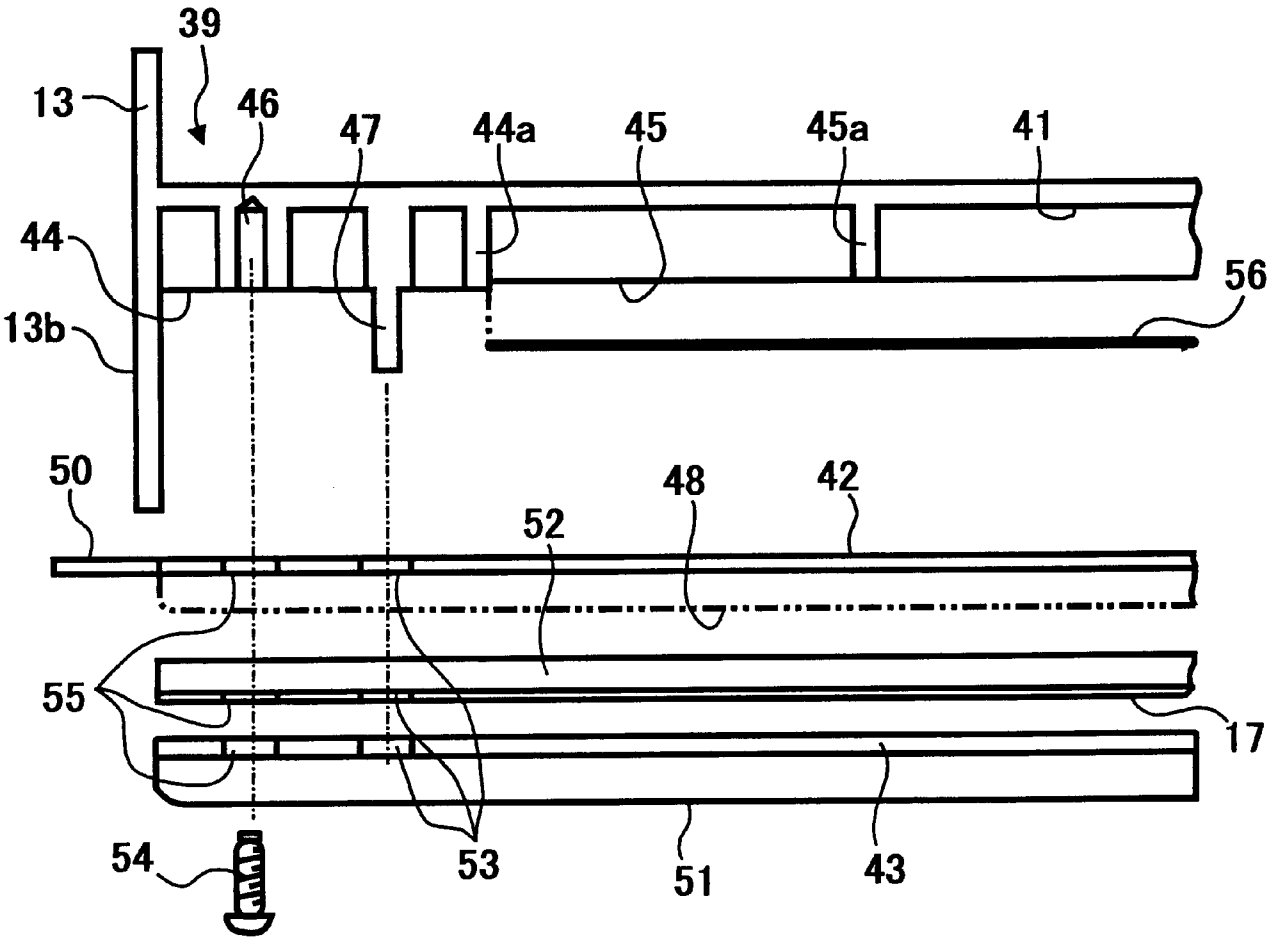
FIG. 5 is a horizontal cross section illustrating an exemplary structure of supporting a blade to a developing case.

FIG. 5 is a horizontal cross section illustrating the support structure of the blade 17 relative to the developing case 13. As illustrated in the drawing, a blade mounting surface 44 is formed in the vicinity of both ends of the outer wall 41 and a recessed surface 45 is formed at the center part of the outer wall 41. The surface of the recessed surface 45 is slightly recessed from the surface of the blade mounting surface 44. A screw hole 46 and an axially-formed protrusion 47 for positioning are formed at the blade mounting surface 44. A bent piece 48 that opposes to the cover 40 of the developing case 13 and a protrusion piece 50 that passes through a hole formed on the supporting wall 13*b* (not shown) at one side of the developing case 13 are formed in the blade holder 42. A bent piece 51 that contacts the bent piece 48 of the blade holder 42 is formed at an upper edge of the supporting plate 43. The blade 17 includes a bent piece 52 that is bent in a L shape at a lower end of the blade 17, and thereby it is avoided that an edge of the end of the blade 17 contacts a surface of the developing roller 15. Further, positioning holes 53 and screw mounting holes 55 are formed at both end sides of the blade holder 42, the blade 17 and the supporting plate 43. The protrusion 47 at the blade mounting surface 44 is inserted into the positioning holes 53 and a mounting screw 54 is passed through the screw mounting holes 55 so as to be engaged with the screw hole 46.

The shape of the positioning hole 53 of the blade 17 at one side of the blade 17 is different from that of the positioning hole at the other side of the blade 17. In more detail, the positioning hole 53 at one side of the blade 17 is shaped in a circle having an internal diameter identical to the outer diameter of the protrusion 47, and the positioning hole 53 at the other side of the blade 17 is shaped in a hole elongated in the axial direction of the developing roller 15 with a width corresponding to the outer diameter of the protrusion 47. By this arrangement, the mounting position of the blade 17 relative to the developing case 13 can be adjusted. Therefore, the shape of the mounting hole 55 can be any shape. The shape of the positioning hole 53 and the mounting hole 55 of the blade holder 42 and the supporting plate 43 are made substantially the same as those of the blade 17.

When the developing case 13 is made in plastic molding, it is very hard to form the surface of the blade mounting surface 44, which is formed in the outer wall 41 of the developing cover 13, in a completely flat shape over the entire length thereof so as to correspond to the blade 17. For this reason, the blade mounting surface 44 is formed in a limited area of the outer wall 41 in the vicinity of both ends of the outer wall 41 and the recessed surface 45 is formed at the center part of the outer wall 41. It is desirable that no gap exists between the recessed surface 45 and the blade holder 42. Therefore, a thin sheet 56 having elasticity, such as a polyethylene film, is arranged between the recessed surface 45 and the blade holder 42. The thickness of the outer wall 41 is made the same for the blade mounting surface 44 and the recessed surface 45 and the blade mounting surface 44 and the recess plane are both formed by a group of ribs 44*a* and 45*a* so as to avoid forming sink marks when molded (FIGS. 5 and 6).

Figure 6:
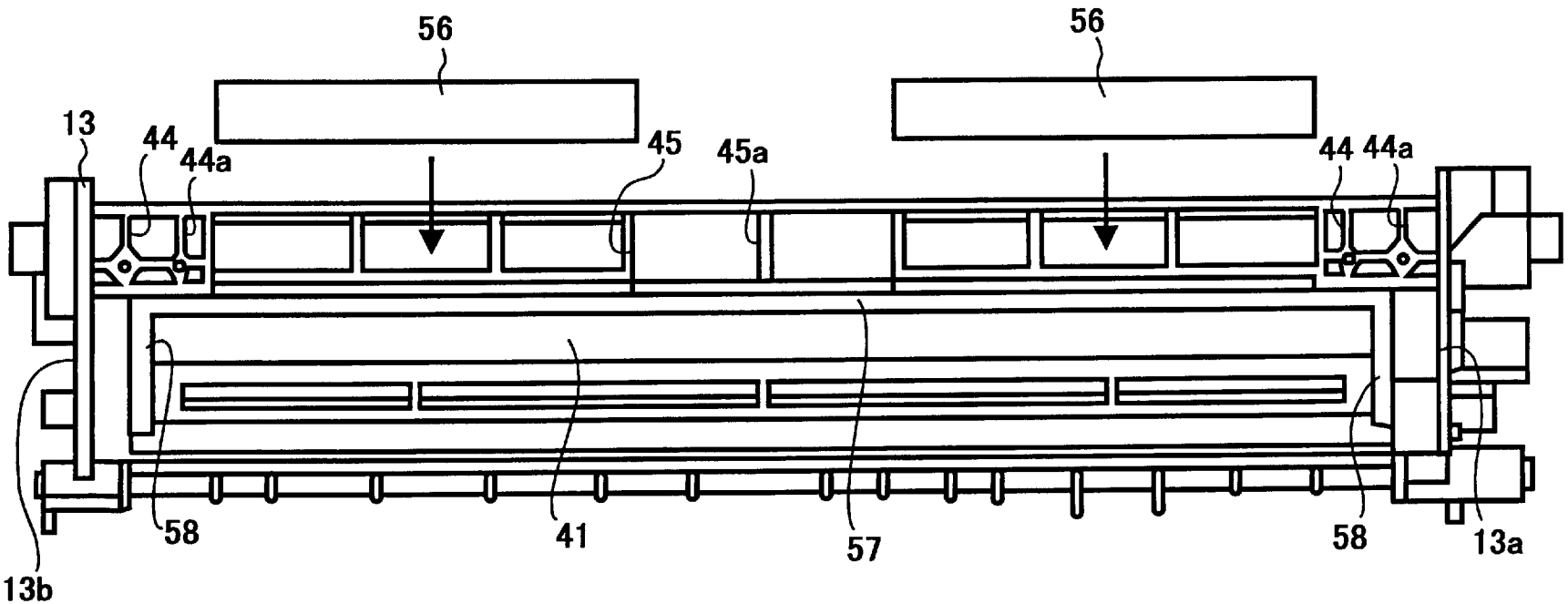
FIG. 6 is a front view of the developing case when the blade and a developing roller are removed.

Further, as illustrated in FIG. 6, a seal member 57 is attached to the outer wall 41 of the developing case 13. Both end parts of the seal member 57 are bent downward so as to form contact parts 58, which contact the outer circumferential surface of the developing roller 15.

Figure 7:
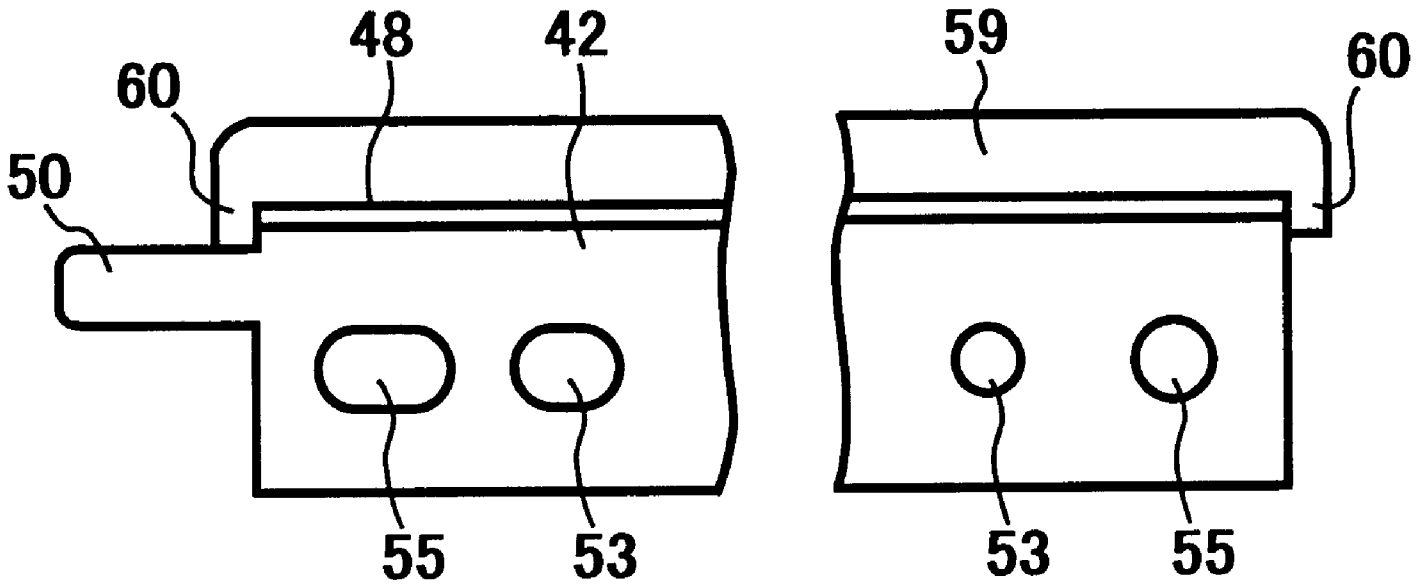
FIG. 7 is a schematic front view explaining a relation between a blade holder and a seal member.

In addition, as illustrated in FIG. 7, a seal member 59 is attached to the bent piece 48 of the blade holder 42 so as to contact the outer wall 41 and the lower surface of the cover 40. The seal member 59 is longer than the entire length of the blade holder 42 except the protrusion 50, and both end parts of the seal member 59 are bent so as to form bent parts 60. The bent parts 60 seal the gap between the supporting walls 13*a* and 13*b* (FIGS. 4 and 6) of the developing case 13 and the blade holder 42.

FIGS. 8(*a*) and 8(*b*) illustrate the support structure of the blade 17 and the seal members 57 and 59. FIG. 8(*a*) is a vertical cross side view at the blade mounting surface 44 of the developing case 13 and FIG. 8(*b*) is a similar view at the recessed surface 45. As illustrated in the drawings, the seal member 57 is disposed along the longitudinal edge of the blade holder 42 at the side of the developing roller 15 and is sandwiched by the backside of a deformable part of the blade 17 (i.e., a part not sandwiched by the blade holder 42 and the supporting plate 43) and the outer wall 41 of the developing case 13. The seal member 59 is disposed along the edge of the blade holder 42 at the opposite side of the seal member 57.

When a latent image is developed with the above-described developing device 11, toner in the developing case 13 is charged by friction between the developing roller 15 and the toner supply roller 16 and further by friction between the developing roller 15 and the blade 17. The developing roller 15 rotates in the counterclockwise direction in FIGS. 1, 3 and 8 and the toner passed under the blade 17 adheres to the developing roller 15. A latent image on the photoconductor 9 is developed with the toner supplied to the developing roller 15.

When the process cartridge 3 or the developing device 11 is handled by itself and if the process cartridge 3 or the developing device 11 falls, for example, the developing cover 13 may be shocked and thereby the developing roller 15 and the blade 17 may vibrate. However, because the seal member 57 is provided along the lower edge of the blade holder 42 to seal the gap between the blade 17 and the outer wall 41 and the seal member 59 is provided along the upper edge of the blade holder 42 to seal the gap between the lower surface of the cover 40 and the outer wall 41, toner in the developing case 13 is prevented from passing the backside of the blade holder 42 and the blade 17 and leaking to the outside of the developing cover 13.

Further, when the blade holder 42, the blade 17 and the supporting plate 43 are metal, if each length of the blade holder 42, the blade 17 and the supporting plate 43 is longer than the interval between the supporting walls 13*a* and 13*b* of the developing case 13, the blade holder 42, the blade 17 and the supporting plate 43 cannot be assembled inside of the supporting walls 13*a* and 13*b*. Therefore, each length of the blade holder 42, the blade 17 and the supporting plate 43 is required to be at least shorter than the interval between the supporting walls 13*a* and 13*b* of the developing case 13. However, due to manufacturing tolerance of the blade holder 42, the blade 17 and the supporting plate 43, a gap may exist between both ends of the blade holder 42, the blade 17 and the supporting plate 43 and the supporting walls 13*a* and 13*b*. However, the seal member 59 is made longer than the longitudinal length of the blade holder 42 and is supported by the blade holder 42 with both end parts of the seal member 59 bent along the sides of both ends of the blade holder 42. Therefore, the gap between the both longitudinal ends of the blade 17, the blade holder 42 and the supporting plate 43 and the inside surface of the supporting walls 13*a* and 13*b* is sealed by the bent parts 60 of the seal member 59.

Further, both end parts of the blade holder 42 are attached to the blade mounting surface 44 and the sheet 56 is disposed between the recessed surface 45 at the center of the developing case 13 and the blade holder 42. Therefore, even when the developing case 13 is shocked, the seal member 57 will never intrude, even partly, between the blade holder 42 and the recessed surface 45, and toner is prevented from being leaked through the recessed surface 45.

In addition, by attaching both end parts of the blade holder 42 to the blade mounting surface 44, the blade holder 42, the blade 17 and the supporting plates 43 can be supported by the outer wall 41 without causing a curvature in the longitudinal direction, and thereby the blade 17 can contact the developing roller 15 with the contact line between the blade 17 and the developing roller 15 made straight.

Further, by making the seal member 57 with a material that has a finer (or higher) density than the toner particles and a rigidity that will not cause any deformation of the blade 17, the sealing property of the sealing member 57 for the gap between the backside of the blade 17 and the seal member 57 can be enhanced with the load given to the developing roller 15 by the seal member 57 made relatively small. The seal member 57 can be formed with, for example, a material of a foaming urethane system.

Specifically, when the process cartridge 3 is tested for a drop, in which the seal member 57 having the hardness of 30 kgf or less (according to 6.3 (A method) of Japanese Industrial Standard K 6400), the density of 0.07 g/cm$^3$ or less (14 times or more in the foaming coefficient), and the permeability of 5 cc/cm$^2$/sec or less (according to 13.1 (A method) of Japanese Industrial Standard K 6400) is used, no leakage of toner has been observed at the backside of the blade 17. No undesirable effect due to deformation of the blade 17 caused by pressure from the seal member 57 has been observed either. The effect of deformation of the blade 17 was determined by measuring the amount of toner adhered on the developing roller 15.

Now, another developing device according to the second embodiment of the present invention is described. The parts substantially the same as those illustrated in FIG. 1 through FIG. 8 are denoted by the same numerals or codes and the description thereof is omitted. The structure of a seal that prevents toner from leaking from around the developing roller 15 is specifically described. As illustrated in FIG. 9 through FIG. 11, in the developing case 13, a toner exit 61 in which the roller part 34 of the developing roller 15 is disposed and a flat surface 62 extending from a lower edge of the toner exit 61 toward the photoconductor 9 are formed. An exit seal 63, that is made of an elastic plastic film such as polyester, is stuck to the flat surface 62 by adhesion or the like. The free end side of the exit seal 63, i.e., the toner exit 61 side of the exit seal 63, that extends beyond the edge of the flat surface 62, elastically contacts the outer circumferential surface of the roller part 34 of the developing roller 15 by its own elasticity.

As illustrated in FIG. 10 through FIG. 12, side seals 64 are stuck to both sides of the toner exit 61 so as to contact the outer circumferential surfaces of both end parts of the roller part 35, respectively. Both longitudinal ends of the exit seal 63 are laid over the side seals 64, respectively.

Further, although only one side of the developing device 11 is illustrated in the drawings, corner seals 65 and clips 66 are provided so as to seal corners where both longitudinal ends of the exit seal 63 and the supporting walls 13*a* and 13*b* contact each other, respectively. The clip 66 is formed with a metal plate having elasticity and includes a contact piece 67 which is brought into contact with the lower surface of the flat surface 62 and a pressure piece 68 which elastically presses the corner seal 65 from the above. Both ends of the flat surface 62 and the exit seal 63, and the corner seals 65, are elastically sandwiched between the contact piece 67 and the pressure piece 68 of the clip 66.

Further, in this embodiment, the supporting walls 13*a* and 13*b* do not extend to the position aligning with the tip end of the flat surface 62. Therefore, the corner seal 65 to be placed on the exit seal 63 and the pressure piece 68 of the clip 66 are both formed in a L-shape, as illustrated in FIG. 10, so as to contact an inner surface 13*c* and an end surface 13*d* (orthogonal to the inner surface 13*c*) of the supporting walls 13*a* and 13*b*. The corner seal 65 is configured such that two sides of the corner seal 65 forming a L-shape contact the inner surface 13*c* and the end surface 13*d* with the two sides rolled up.

As illustrated in FIGS. 8 and 9, the blade 17 is configured such that the part extending downward beyond the blade holder 42 bents toward the rear side of the developing case 13 by being pressed with the roller part 34 of the developing roller 15 and the bent piece 52 contacts the roller part 34. Therefore, as indicated by a one-dot chain line in FIG. 12, the contact position C of the roller part 34 and the blade 17 is located in a position slightly above the lower edge of the blade 17.

Further, as illustrated in FIGS. 10 through 12, the blade 17 includes a wide-width part 69 with both longitudinal ends thereof faced the side seals 64 (i.e., overlaid with the side seals 64), a narrow-width part 70 located below the wide-width part 69 in the drawings and a step part 71 forming the boundary between the wide-width part 69 and the narrow-width part 70. As illustrated in FIG. 12, the step part 71 is located above the contact position C of the blade 17 and the roller part 34 (downstream of the contact position C in the rotating direction of the developing roller 15). The length of the narrow-width part 70 located below the step part 71 in the drawings is made such that, when the blade 17 is pressed by the roller part 34 of the developing roller 15, the narrow-width part 70 can be bent toward the rear side of the toner exit 61 by pressure of the developing roller 15, even after the wide-width part 69 contacts the side seals 64. More specifically, in FIG. 12, the length L2 of the narrow-wide part 70 is set to a length ΔL longer than an interval L1 between the inside surfaces of the side seals 64 and the narrow-width part 70 is overlapped with the side seals 64 by a distance ΔL/2 (for example, 0.1–0.5 mm) at both ends of the narrow-width part 70, respectively. When the overlapping distance is about ΔL/2, the narrow-wide part 70 of the blade 17 can be bent toward the rear side of the toner exit 61 by pressure of the developing roller 15 by elastically deforming the edges of the side seals 64 which are overlaid with the narrow-width part 70.

Thus, the blade 17 can be put into contact with the roller part 34 over the entire length of the roller part 34 and further the both sides of the roller part 34 can be securely put into contact with the side seals 64 by bending action of the narrow-width part 70 below the step part 71.

Further, the corners where the longitudinal ends of the exit seals 63 and the supporting walls 13*a* and 13*b* contact each other can be sealed by the corner seals 65, respectively. Also, both ends of the exit seals 63 and the corner seals 65 can be pressed together against the flat surface 62 with the clip 66, respectively. The corner seals 65 are condensed by being pressed by the clip 66 and thereby leakage of toner is prevented more effectively.

Furthermore, because the wide-width parts 69 are formed at both longitudinal ends of the blade 17 so as to face the side seals 64 respectively, intrusion of toner toward both sides of the toner exit 61 is suppressed. In addition, when the narrow-width part 70 is pressed by the developing roller 15 and the narrow-width part 70 is pressed against the side seals 64, bending of the narrow-width part 70 will not be hampered. Thus, the outer circumferential surfaces of the roller part 34 of the developing roller 15 can be securely put into contact with the side seals 64. Because the length L2 of the narrow-width part 70 is slightly longer than the interval L1 between the side seals 64, intrusion of toner toward both sides of the blade 17 can be also suppressed. Thus, toner leakage around the developing roller 15 is effectively prevented.

Next, another developing device 11 according to the third embodiment of the present invention is described in reference to FIG. 13 through FIG. 15. The parts substantially the same as those in the previous embodiments are denoted by the same numerals or codes and the description thereof is omitted. This embodiment relates to a seal construction for a part of the developing case 13, in which respective ends of the stirring device 14 and the toner supplying roller 16 at one side protrude outside of the developing case 13 so that a power is transmitted thereto. As illustrated in FIG. 15, an engaging hole 80 is formed in a wall of a case of the developing device 11, i.e., in the supporting wall 13*a* of the developing case 13, and a bearing 81 is fit into the engaging hole 80. When the bearing 81 is fit into the engaging hole 80, a bearing seal 82, which is formed in a donut shape with foaming polyurethane, is fixed by adhesion to one end of the bearing 81 at the side of the toner container part 13*e*. A rotating axis 16*a* of the toner supply roller 16 is inserted into the bearing seal 82 and the bearing 81 so as to protrude outside of the developing case 13. The end of the rotating axis 16*a* protruded outside of the developing case 13 engages with a gear 84 of a power transmitting mechanism 83 (FIG. 13).

The outer diameter "a" of the bearing seal 82 is larger than the inner diameter "b" of the engaging hole 80 by 0.2–1.0 mm in the radius. That is, (a–b)/2=0.2–1.0 mm. The inner diameter "d" of the bearing seal 82 is smaller than the inner diameter "c" of the bearing 81 by 0.2–1.0 mm in the radius. That is, (d–c)/2=–0.2––1.0 mm.

A D-shaped part 85, in which the cross section is shaped like the character "D", is formed at the tip end of the rotating axis 16*a* for stopping rotation of the engaged gear 84. A chamfer 86 is formed between a part of the rotating axis 16*a* where the D-shaped part 85 is formed and a part where the D-shaped part 85 is not formed.

Further, as illustrated in FIG. 14, an insertion hole 87 is formed in the supporting walls 13*a* and a rotating axis 14*a* of the stirring device 14 is inserted through the insertion hole 87. A donut-shaped inner seal 88 is engaged at a part of the rotation axis 14*a* which is located inside of the toner container part 13*e* and the side of the inner seal 88 is in contact with the inner surface of the supporting wall 13*a*.

The end of the rotation axis 14*a* protruded outside of the developing case 13 engages with a gear 89 of the power transmission 83. The gear 89 is prevented from being released from the rotation axis 14*a* by inserting a flexible stopping claw 90, that is formed at the end of the rotation axis 14*a*, into an insertion hole 91 formed in the gear 89 and by engaging a tip end of the stopping claw 90 with a stepped part 92 formed in the gear 89.

An outer seal 93 is stuck to the outside surface of the gear 89, at which the stopping claw 90 is engaged, so as to seal the insertion hole 91. An opening (not shown) for supplying toner is formed in the supporting wall 13*a* of the developing cover 13 and the opening is tightly closed by a closing cap 94 as illustrated in FIG. 13.

In FIG. 13, numeral 100 denotes a photoconductor unit, which is formed by assembling a photoconductor case 8, a photoconductor 9, a charging roller 10 and a shutter 33 into an integrated unit. A process cartridge 3 is assembled by connecting the photoconductor unit 100 and the developing unit 11. The process cartridge 3 is attached to the main body 1 (FIG. 1) in a detachable manner.

When the developing device 11 is assembled, the bearing 81 is fit into the engaging hole 80 by thrusting the bearing 81 having the bearing seal 82 attached at one end thereof by adhesion into the engaging hole 80 from the outside of the supporting wall 13*a*. The outer diameter "a" of the bearing seal 82 is made larger than the inner diameter "b" of the engaging hole 80 by 0.2–1.0 mm in the radius. However, because the bearing seal 82 is made of foaming polyurethane, the bearing seal 82 has high compressibility. Therefore, when the bearing 81 is fit into the engaging hole 80 from the outside of the supporting walls 13*a*, the bearing seal 82 can be easily compressed to a size with an outer diameter smaller than the inner diameter of the engaging hole 80 such that the bearing 81 can be easily fit into the engaging hole 80. Once the bearing seal 82 passes through the engaging hole 80, the bearing seal 82 is decompressed to the original size and the part of the bearing seal 82 extending beyond the inner diameter of the engaging hole 80 contacts a circumference of the engaging hole 80 at an inner surface of the supporting wall 13*a*.

Accordingly, with the provision of the bearing seal 82, toner is prevented from intruding into a gap between the inner circumferential surface of the engaging hole 80 and the outer circumferential surface of the bearing 81 and thereby toner leakage through the gap between the inner circumferential surface of the engaging hole 80 and the outer circumferential surface of the bearing 81 is prevented. Further, because the bearing seal 82 made of foaming polyurethane is inexpensive, a relatively inexpensive seal mechanism can be realized by using the bearing seal 82 made of foaming polyurethane.

Further, although the inner diameter "d" of the bearing seal 82 is made shorter than the inner diameter "c" of the bearing 81 by 0.2–1.0 mm in the radius, because the bearing seal 82 made of foaming polyurethane has high compressibility, in assembling the developing device 11, when the rotation axis 16*a* of the toner supply roller 16 is inserted through the bearing seal 82, the bearing seal 82 is easily compressed to a size having an inner diameter through which the rotation axis 16*a* can be easily inserted, and thereby the operation of inserting the rotation axis 16*a* through the bearing seal 82 and the bearing 81 can be easily performed.

In addition, a sharp drop is not formed in the longitudinal outer circumferential surface of the rotation axis 16*a* because the chamfer 86 is formed between a part of the rotating axis 16*a* where the D-shaped part 85 is formed and a part where the D-shaped part 85 is not formed. Accordingly, when the rotation axis 16*a* is inserted through the bearing seal 82, the chamfer 86 contacts the inner circumferential part of the bearing seal 82 and thereby the inner circumferential part of the bearing seal 82 is gradually compressed in the radial direction. Thus, the chamfer 86 contacts the inner circumferential part of the bearing seal 82 along the insertion direction of the rotation axis 16*a* and thereby damaging of the bearing seal 82 is avoided.

Further, in assembling the developing device 11, the rotation axis 14*a* of the stirring device 14 is inserted through the insertion hole 87 formed in the supporting wall 13*a* so as to protrude the stopping claw 91 outside of the developing case 13. The protruded stopping claw 91 is inserted into the insertion hole 91 of the gear 89 and the stopping claw 90 is engaged with the stepped part 92 of the gear 89. Further, the outer seal 93 is stuck to the outer surface of the gear 89 so as to seal the insertion hole 91.

Therefore, when toner leaks outside of the developing device 11 through a gap between the inner circumferential surface of the insertion hole 87 and the outer circumferential surface of the rotation axis 14*a*, the toner passes around the stopping claw 90 and intrudes into the insertion hole 91 of the gear 89. The toner intruded into the insertion hole 91 is sealed by the outer seal 93 and is prevented from being scattered from the insertion hole 91 to the circumference. Thus, the circumference of the developing device 11 is prevented from being soiled by scattering toner. In particular, in this embodiment, scattering of toner is prevented by a simple and inexpensive construction, as described above, to stick the outer seal 93 to the outer surface of the gear 89.

Now, another photoconductor unit according to the fourth embodiment of the present invention is described with reference to FIGS. 16–18. The parts substantially the same as those in the previous embodiments are denoted by the same numerals or codes and the description thereof will be omitted. As in FIG. 13, a photoconductor unit 100 is formed by assembling a photoconductor case 8, a photoconductor 9, a charging roller 10 and a shutter 33 into an integrated unit. A process cartridge 3 is assembled by connecting the photoconductor unit 100 and the developing unit 11. The process cartridge 3 is attached to the main body 1 (FIG. 1) in a detachable manner.

The fourth embodiment relates to a construction to prevent leakage of collected used toner in the inside of the photoconductor unit 100. As illustrated in FIG. 16, a used toner collecting unit 101 is formed in the photoconductor case 8. A long and narrow collecting inlet 102 is formed in the used toner collecting unit 101 at a position adjacent to the outer circumferential surface of the photoconductor 9. The collecting inlet 102 is formed along substantially the entire length of the photoconductor 9. Side seals 103 made of teflon felt are stuck to both longitudinal ends of the used toner collecting inlet 102 and the outer circumferential surfaces of both ends of the photoconductor 9 slidably contacts the side seals 103. A long blade 104 is fixed to one longitudinal edge of the collecting inlet 102 so as to scrape off residual used toner on the outer circumferential surface of the photoconductor 9. A long inlet seal 105 is stuck to the other longitudinal edge of the collecting inlet 102 so as to slidably contact the outer circumferential surface of the photoconductor 9.

Support parts 106 are formed at both longitudinal ends of the inlet seal 105 so as to increase the sticking area of the inlet seal 105 to the edges of the collecting inlet 102 and thereby to make the inlet seal 105 hard to be peeled off. The support parts 106 are formed in a rectangle shape protruded in the direction orthogonal to the longitudinal direction of the inlet seal 105.

The longitudinal ends of the inlet seal 105 are laid over the side seals 103 with respective outer edges aligned with each other. Further, pressing seals 107 formed, for example, with foaming polyurethane, are stuck to the both longitudinal ends of the inlet seal 105. The pressing seal 107 is formed substantially in a L-shape by a fixing part 107*a* and a leakage preventing part 107*b*. The fixing part 107*a* is stuck on a part of the inlet seal 105, which is stuck to the longitudinal edge of the collecting inlet 102 at the longitudinal end of the inlet seal 105, and the leakage preventing part 107*b* is stuck to the circumferential edge of the collecting inlet 102 while contacting the outer end surfaces of the side seal 103 and the inlet seal 105.

With the above-described configuration, the photoconductor 9 is rotated in the direction indicated by an arrow in FIG. 16, and residual used toner on the outer circumferential surface of the photoconductor 9 is scraped off the surface of the photoconductor 9 by the blade 104. The scraped off used toner is collected into the used toner collecting part 101 through the collecting inlet 102. When the photoconductor 9 is rotated as above, the inlet seal 105 is slidably contacting the outer circumferential surface of the photoconductor 9, and therefore a pulling force along the rotating direction of the photoconductor 9 is applied to the inlet seal 105 from the photoconductor 9. However, because the supporting parts 106 are formed at both longitudinal ends of the inlet seal 105 so as to increase the sticking area of the inlet seal 105 to the edges of the collecting inlet 102 and thereby the supporting parts 105 are firmly stuck to the edges of the collecting inlet 105, even when the pulling force is applied to the inlet seal 105 according to the rotation of the photoconductor 9, the both ends of the inlet seal 105 will not be pealed off. Therefore, it will not occur that both ends of the inlet seal 105 are peeled off and are thereby shifted toward the center of the inlet seal 105. Accordingly, waving of the inlet seal 105 will not occur at a part of the inlet seal 105 slidably contacting the outer circumferential surface of the photoconductor 9. Therefore, leakage of toner through a nip portion of the inlet seal 105 and the outer circumferential surface of the photoconductor 9 is prevented.

Further, the pressing seals 107 are stuck to both longitudinal ends of the inlet seal 105 and the leakage preventing parts 107*b* of the pressing seal 107 are stuck to the edges of the collecting inlet 102 while contacting the outer end surfaces of the side seal 103 and the inlet seal 105. Therefore, even if collected used toner intrudes into a part where the side seal 103 and the inlet seal 105 are overlaid, the collected used toner is prevented from leaking toward the ends of the inlet seal 105 by the leakage preventing part 107*b* of the pressing seal 107 and thereby leakage of collected used toner from the end sides of the inlet seal 105 is securely prevented.

Numerous additional modifications and variations of the present invention are possible in light of the above teachings. It is therefore to be understood that within the scope of the appended claims, the present invention may be practiced otherwise than specifically described herein.

This document claims priority and contains subject matter related to Japanese patent applications No. 10-301326, No. 10-301327, No. 10-301329, No. 10-303848, No. 10-308454, No. 10-308456, No. 10-367439, No.10-367440 and No. 11-184687 filed in the Japanese Patent Office on Oct. 22, 1998, Oct. 22, 1998, Oct. 22, 1998, Oct. 26, 1998, Oct. 29, 1998, Oct. 29, 1998, Dec. 24, 1998, Dec. 24, 1998, and Jun. 30, 1999, respectively, and the entire contents of which are hereby incorporated by reference.

What is claimed as new and is desired to be secured by Letters Patent of the United States:

1. A developing device, comprising a developing roller opposed to a photoconductor and rotatably mounted to a developing case of the developing device, a blade mounting surface formed in an outer wall of the developing case, that is opposed to the photoconductor, a blade holder, a blade and a supporting member, laminated with each other, and mounted to the blade mounting surface of the developing case, a first part of the blade located opposite to a second part of the blade, which is sandwiched between the blade holder and the supporting member, and elastically bent so as to contact an outer circumferential surface of the developing roller, and seal members arranged at least along an edge of a longitudinal side of the blade holder at a side of the developing roller and along an edge of another longitudinal side of the blade holder at an opposite side of the developing roller, respectively, so as to increase airtightness of gaps between the blade holder and the outer wall of the developing case.

2. A developing device according to claim 1, wherein the seal members are longer than a longitudinal length of the blade holder, and the seal members have longitudinal ends that are bent along sides of ends of the blade holder, respectively.

3. A process cartridge, comprising a developing device mounted to a photoconductor case in which a photoconductor is rotatably supported, a developing roller opposed to the photoconductor and rotatably mounted to a developing case of the developing device, a blade mounting surface formed in an outer wall of the developing case, that is opposed to the photoconductor, a blade holder, a blade and a supporting member laminated with each other and mounted to the blade mounting surface of the developing case, a first part of the blade located opposite to a second part of the blade, which is sandwiched between the blade holder and the supporting member, and elastically bent so as to contact an outer circumferential surface of the developing roller, and seal members arranged at least along an edge of a longitudinal side of the blade holder at a side of the developing roller and along an edge of another longitudinal side of the blade holder at an opposite side of the developing rollers respectively, so as to increase airtightness of gaps between the blade holder and the outer wall of the developing case.

4. An image forming apparatus, comprising:

a process cartridge, in which a developing device is mounted to a photoconductor case in which a photoconductor is rotatably supported, a developing roller opposed to the photoconductor is rotatably mounted to a developing case of the developing device, a blade mounting surface is formed in an outer wall of the developing case, that is opposed to the photoconductor, a blade holder, a blade and a supporting member, that are laminated with each other, and are mounted to the blade mounting surface of the developing case, a first part of the blade is located opposite to a second part of the blade, which is sandwiched between the blade holder and the supporting member, and is elastically bent so as to contact an outer circumferential surface of the developing roller, and seal members are arranged at least along an edge of a longitudinal edge of the blade holder at a side of the developing roller and along an edge of another longitudinal side of the blade holder at an opposite side of the developing roller, respectively, so as to increase airtightness of gaps between the blade holder and the outer wall of the developing case;

a transfer device configured to transfer a toner image formed on the photoconductor to a transfer sheet; and a fixing device configured to fix the transferred toner image onto the transfer sheet.

5. A developing device, comprising a developing roller opposed to a photoconductor and rotatably mounted to a developing case of the developing device, blade mounting surfaces and a recessed surface formed in an outer wall of the developing case, that is opposed to the photoconductor, in vicinity of longitudinal ends and at a center part of the outer wall, respectively, a portion of the recessed surface being recessed from a portion of the blade mounting surfaces, a blade holder, a blade and a supporting member laminated with each other and mounted to the blade mounting surfaces, a first part of the blade located opposite to a second part of the blade, which is sandwiched between the blade holder and the supporting member, and elastically bent so as to contact an outer circumferential surface of the developing roller, seal members arranged at least along an edge of a longitudinal side of the blade holder at a side of the developing roller and along an edge of another longitudinal side of the blade holder at an opposite side of the developing roller, respectively, so as to increase airtightness of gaps between the blade holder and the outer wall of the developing case, and a packing member arranged in a gap between a center part of the blade holder and the recessed surface.

6. A developing device according to claim 5, wherein the seal members are formed with a material that has a density higher than that of toner particles and a rigidity that will not cause any deformation of the blade.

7. A process cartridge, comprising a developing device mounted to a photoconductor case in which a photoconductor is rotatably supported, a developing roller opposed to the photoconductor and rotatably mounted to a developing case of the developing device, blade mounting surfaces and a recessed surface formed in an outer wall of the developing case, that is opposed to the photoconductor, in vicinity of longitudinal ends and at a center part of the outer wall, respectively, a portion of the recessed surface being recessed from a portion of the blade mounting surfaces, blade holder, a blade and a supporting member laminated with each other and mounted to the blade mounting surfaces, a first part of the blade located opposite to a second part of the blade, which is sandwiched between the blade holder and the supporting member, and elastically bent so as to contact an outer circumferential surface of the developing roller, seal members arranged at least along an edge of a longitudinal side of the blade holder at a side of the developing roller and along an edge of another longitudinal side of the blade holder at an opposite side of the developing roller, respectively, so as to increase airtightness of gaps between the blade holder and the outer wall of the developing case; and a packing member arranged in a gap between a center part of the blade holder and the recessed surface.

8. An image forming apparatus, comprising:

a process cartridge, in which a developing device is mounted to a photoconductor case in which a photoconductor is rotatably supported, a developing roller opposed to the photoconductor is rotatably mounted a developing case of the developing device, blade mounting surfaces and a recessed surface are formed in an outer wall of the developing case, that is opposed to the photoconductor, in vicinity of longitudinal ends and at a center part of the outer wall, respectively, a portion of the recessed surface being recessed from a portion of the blade mounting surfaces, a blade holder, a blade and a supporting member, that are laminated with each other, and are mounted to the blade mounting surfaces, a first part of the blade is located opposite to a second part of the blade, which is sandwiched between the blade holder and the supporting member, and is elastically bent so as to contact an outer circumferential surface of the developing roller, seal members are arranged at least along an edge of a longitudinal side of the blade holder at a side of the developing roller and along an edge of another longitudinal side of the blade holder at an opposite side of the developing roller, respectively, so as to increase airtightness of gaps between the blade holder and the outer wall of the developing case, and a packing member is arranged in a gap between a center part of the blade holder and the recessed surface;

a transfer device configured to transfer a toner image formed on the photoconductor to a transfer sheet; and a fixing device configured to fix the transferred toner image onto the transfer sheet.

9. A developing device, comprising:

a developing case in which a toner exit opposed to a photoconductor and a flat surface extended from a lower edge of the toner exit toward the photoconductor are formed;

a developing roller including an axial part rotatably supported by supporting walls provided at sides of the developing case and a roller part disposed at the toner exit;

a blade that is configured such that a lower edge thereof contacts the roller part of the developing roller so as to seal a gap between an upper edge of the toner exit and an upper outer circumferential surface of the roller part of the developing roller;

a thin exit seal that is supported by the flat surface of the developing case, a free end side thereof extended toward the inside of the toner exit elastically contacting the roller part of the developing roller; and corner seals that seal corners where edges of longitudinal ends of the exit seal and the supporting walls of the developing case contact each other, respectively.

10. A developing device, comprising:

a developing case in which a toner exit opposed to a photoconductor and a flat surface extended from a lower edge of the toner exit toward the photoconductor are formed;

a developing roller including an axial part rotatably supported by supporting walls provided at sides of the developing case and a roller part disposed at the toner exit;

a blade configured such that a lower edge thereof contacts the roller part of the developing roller so as to seal a gap between an upper edge of the toner exit and an upper outer circumferential surface of the roller part of the developing roller;

a thin exit seal that is supported by the flat surface of the developing case, a free end side thereof extended toward the inside of the toner exit elastically contacting the roller part of the developing roller; and clips that elastically sandwich longitudinal ends of the exit seal and the flat surface of the developing case respectively.

11. A developing device according to claim 10, further comprising:

corner seals that seal corners where longitudinal ends of the exit seal and the supporting walls of the developing case contact each other, respectively.

12. A process cartridge, comprising a developing device mounted to a photoconductor case in which a photoconductor is rotatably supported, the developing device including;

a developing case in which a toner exit opposed to the photoconductor and a flat surface extended from a lower edge of the toner exit toward the photoconductor are formed, a developing roller including an axial part rotatably supported by supporting walls provided at sides of the developing case and a roller part disposed at the toner exit, a blade that is configured such that a lower edge thereof contacts the roller part of the developing roller so as to seal a gap between an upper edge of the toner exit and an upper outer circumferential surface of the roller part of the developing roller, a thin exit seal that is supported by the flat surface of the developing case, a free end side thereof extended toward the inside of the toner exit elastically contacting the roller part of the developing roller, and corner seals that seal corners where longitudinal ends of the exit seal and the supporting walls of the developing case contact each other, respectively.

13. A process cartridge, comprising a developing device mounted to a photoconductor case in which a photoconductor is rotatably supported, the developing device including;

a developing case in which a toner exit opposed to the photoconductor and a flat surface extended from a lower edge of the toner exit toward the photoconductor are formed, a developing roller including an axial part rotatably supported by supporting walls provided at sides of the developing case and a roller part disposed at the toner exit, a blade configured such that a lower edge thereof contacts the roller part of the developing roller so as to seal a gap between an upper edge of the toner exit and an upper outer circumferential surface of the roller part of the developing roller, a thin exit seal that is supported by the flat surface of the developing case, a free end side thereof extended toward the inside of the toner exit elastically contacting the roller part of the developing roller, and clips that elastically sandwich longitudinal ends of the exit seal and the flat surface of the developing cover respectively.

14. A process cartridge according to claim 13, wherein the developing device further includes corner seals that seal corners where longitudinal ends of the exit seal and the supporting walls of the developing case contact each other, respectively.

15. An image forming apparatus, comprising:

a process cartridge, in which a developing device is mounted to a photoconductor case in which a photoconductor is rotatably supported, the developing device including a developing case in which a toner exit opposed to the photoconductor and a flat surface extended from a lower edge of the toner exit toward the photoconductor are formed, a developing roller including an axial part rotatably supported by supporting walls provided at sides of the developing case and a roller part disposed at the toner exit, a blade that is configured such that a lower edge thereof contacts the roller part of the developing roller so as to seal a gap between an upper edge of the toner exit and an upper outer circumferential surface of the roller part of the developing roller, a thin exit seal that is supported by the flat surface of the developing case, a free end thereof extended toward the inside of the toner exit elastically contacting the roller part of the developing roller, and corner seals that seal corners where longitudinal ends of the exit seal and the supporting walls of the developing case contact each other, respectively;

a transfer device configured to transfer a toner image formed on the photoconductor to a transfer sheet; and a fixing device configured to fixed the transferred toner image onto the transfer sheet.

16. An image forming apparatus, comprising:

a process cartridge, in which a developing device is mounted to a photoconductor case in which a photoconductor is rotatably supported, the developing device including, a developing case in which a toner exit opposed to the photoconductor and a flat surface extended from a lower edge of the toner exit toward the photoconductor are formed, a developing roller including an axial part rotatably supported by supporting walls provided at sides of the developing case and a roller part disposed at the toner exit, a blade configured such that a lower edge thereof contacts the roller part of the developing roller so as to seal a gap between an upper edge of the toner exit and an upper outer circumferential surface of the roller part of the developing roller, a thin exit seal that is supported by the flat surface of the developing case, a free end side thereof extended toward the inside of the toner exit elastically contacting the roller part of the developing roller, and clips that elastically sandwich longitudinal ends of the exit seal and the flat surface of the developing cover, respectively;

a transfer device configured to transfer a toner image formed on the photoconductor to a transfer sheet; and a fixing device configured to fixed the transferred toner image onto the transfer sheet.

17. An image forming apparatus according to claim 16, wherein the developing device further includes corner seals that seal corners where longitudinal ends of the exit seal and the supporting walls of the developing case contact each other, respectively.

18. A developing device, comprising:

a developing case in which a toner exit opposed to a photoconductor is formed;

a developing roller including an axial part rotatably supported by supporting walls provided at sides of the developing case and a roller part disposed at the toner exit;

side seals arranged at longitudinal ends of the toner exit so as to contact outer circumferential surfaces of longitudinal ends of the roller part of the developing roller; and a blade that is formed with a thin metal plate having elasticity and that is configured such that a lower edge thereof contacts the roller part of the developing roller so as to seal a gap between an upper edge of the toner exit and an upper outer circumferential surface of the roller part of the developing roller, wherein the blade includes a wide-width part having a length such that longitudinal ends thereof face the side seals respectively and a narrow-width part extended from the wide-width part toward upstream of a rotation direction of the developing roller and configured to have a length that enables the narrow-width part to be bent in a direction orthogonal to a longitudinal direction of the developing roller between the side seals arranged at sides of the toner exit, and a step part forming a boundary between the wide-width part and the narrow-width part is disposed downstream of a contact point of the blade and the roller part of the developing roller in the rotation direction of the developing roller.

19. A developing device according to claim 18, wherein the length of the narrow-wide part is made longer than an interval between inside surfaces of the side seals such that, when the blade is pressed by the developing roller, the narrow-wide part bends toward a rear side of the toner exit by pressure of the developing roller even after the wide-width part contacts the side seals.

20. A process cartridge, comprising a developing device is mounted to a photoconductor case in which a photoconductor is rotatably supported, the developing device including, a developing case in which a toner exit opposed to the photoconductor is formed, a developing roller including an axial part rotatably supported by supporting walls provided at sides of the developing case and a roller part disposed at the toner exit, side seals arranged at longitudinal ends of the toner exit so as to contact outer circumferential surfaces of longitudinal ends of the roller part of the developing roller, and a blade that is formed with a thin metal plate having elasticity and that is configured such that a lower edge thereof contacts the roller part of the developing roller so as to seal a gap between an upper edge of the toner exit and an upper outer circumferential surface of the roller part of the developing roller; and wherein the blade includes a wide-width part having a length such that longitudinal ends thereof face the side seals respectively and a narrow-width part extended from the wide-width part toward upstream of a rotation direction of the developing roller and configured to have a length that enables the narrow-width part to be bent in a direction orthogonal to a longitudinal direction of the developing roller between the side seals arranged at sides of the toner exit, and a step part forming a boundary between the wide-width part and the narrow-width part is disposed downstream of a contact point of the blade and the roller part of the developing roller in the rotation direction of the developing roller.

21. An image forming apparatus, comprising:

a process cartridge, in which a developing device is mounted to a photoconductor case in which a photoconductor is rotatably supported, the developing device including, a developing case in which a toner exit opposed to the photoconductor is formed, a developing roller including an axial part rotatably supported by supporting walls provided at sides of the developing case and a roller part disposed at the toner exit, side seals arranged at longitudinal ends of the toner exit so as to contact outer circumferential surfaces of longitudinal ends of the roller part of the developing roller, and a blade that is formed with a thin metal plate having elasticity and that is configured such that a lower edge thereof contacts the roller part of the developing roller so as to seal a gap between an upper edge of the toner exit and an upper outer circumferential surface of the roller part of the developing roller, wherein the blade includes a wide-width part having a length such that longitudinal ends thereof face the side seals respectively and a narrow-width part extended from the wide-width part toward upstream of a rotation direction of the developing roller and configured to have a length that enables the narrow-width part to be bent in a direction orthogonal to a longitudinal direction of the developing roller between the side seals arranged at sides of the toner exit, and a step part forming a boundary between the wide-width part and the narrow-width part is disposed downstream of a contact point of the blade and the roller part of the developing roller in the rotation direction of the developing roller;

a transfer device configured to transfer a toner image formed on the photoconductor to a transfer sheet; and a fixing device configured to fix the transferred toner image onto the transfer sheet.

22. A developing device, comprising a toner accommodating part formed in a developing case of the developing device, a rotating member rotatably housed in the toner accommodating part, a rotating axis of the rotating member passing through a wall of the developing case to protrude outside of the wall of the developing case and a flexible stopping claw formed at an end of the rotating axis protruded outside of the wall of the developing case and inserted into an insertion hole formed in a gear and stopped by being engaged with the gear, and a seal stuck to an outside surface of the gear so as to seal the insertion hole.

23. A developing device, comprising a toner accommodating part formed in a developing case of the developing device, a rotating member rotatably housed in the toner accommodating part, a rotating axis of the rotating member passing through a wall of the developing case to protrude outside of the wall of the developing case, an end of the rotating axis protruded outside of the wall of the developing case and engaged with a gear, an engaging hole formed in the wall of the developing case, a bearing fit into the engaging hole, and a bearing seal formed with foaming polyurethane in a donut shape so as to pass through the rotating axis and fixed to an end of the bearing facing the toner accommodating part, wherein an outer radius of the bearing seal is larger than an inner radius of the engaging hole by about 0.2–1.0 mm.

24. A developing device according to claim 23, wherein a D-shaped part is formed at a part of the rotating axis engaging with the gear and a chamfer is formed between a part of the rotating member where the D-shaped part is formed and a part of the rotating member where the D-shaped part is not formed.

25. A process cartridge, comprising a photoconductor unit, in which a photoconductor is rotatably accommodated, and a developing device are integrated in a body, wherein the developing device includes a toner accommodating part formed in a developing case of the developing device, a rotating member rotatably housed in the toner accommodating part, a rotating axis of the rotating member passing through a wall of the developing case to protrude outside of the wall of the developing case and a flexible stopping claw formed at an end of the rotating axis protruded outside of the wall of the developing case and inserted into an insertion hole formed in a gear and stopped by being engaged with the gear, and a seal stuck to an outside surface of the gear so as to seal the insertion hole.

26. A process cartridge, comprising a photoconductor unit, in which a photoconductor is rotatably accommodated, and a developing device are integrated in a body, wherein the developing device includes a toner accommodating part formed in a developing case of the developing device, a rotating member rotatably housed in the toner accommodating part, a rotating axis of the rotating member passing through a wall of the developing case to protrude outside of the wall of the developing case, an end of the rotating axis protruded outside of the wall of the developing case and engaged with a gear, an engaging hole formed in the wall of the developing case, a bearing fit into the engaging hole, a bearing seal formed with foaming polyurethane in a donut shape so as to pass through the rotating axis and fixed to an end of the bearing facing the toner accommodating part, and an outer radius of the bearing seal that is larger than an inner radius of the engaging hole by about 0.2–1.0 mm.

27. An image forming apparatus, comprising:

a process cartridge having a photoconductor unit in which a photoconductor is rotatably accommodated and a developing device are integrated in a body, and having, in the developing device, a toner accommodating part formed in a developing case of the developing device, a rotating member rotatably housed in the toner accommodating part, a rotating axis of the rotating member passing through a wall of the developing case to protrude outside of the wall of the developing case and a flexible stopping claw formed at an end of the rotating axis protruded outside of the wall of the developing case is inserted into an insertion hole formed in a gear and is stopped by being engaged with the gear, and a seal stuck to an outside surface of the gear so as to seal the insertion hole;

a latent image forming device to form an electrostatic latent image on an outer circumferential surface of the photoconductor by exposing the outer circumferential surface of the photoconductor to light;

a transfer device configured to transfer the latent image on the photoconductor, which has been developed with toner supplied from the developing device, to a transfer sheet; and a fixing device configured to fix the transferred toner image onto the transfer sheet.

28. An image forming apparatus, comprising:

a process cartridge, having a photoconductor unit in which a photoconductor is rotatably accommodated and a developing device are integrated in a body, and having, in the developing device, a toner accommodating part formed in a developing case of the developing device, a rotating member rotatably housed in the toner accommodating part, a rotating axis of the rotating member passing through a wall of the developing case to protrude outside of the wall of the developing case, an end of the rotating axis protruded outside of the wall of the developing case and engaged with a gear, an engaging hole formed in the wall of the developing case, a bearing fit into the engaging hole, a bearing seal formed with foaming polyurethane in a donut shape so as to pass through the rotating axis and fixed to an end of the bearing facing the toner accommodating part, and an outer diameter of the bearing seal that is larger than an inner diameter of the engaging hole by about 0.2–1.0 mm in the radius;

a latent image forming device to form an electrostatic latent image on an outer circumferential surface of the photoconductor by exposing the outer circumferential surface of the photoconductor to light;

a transfer device configured to transfer the latent image on the photoconductor, which has been developed with toner supplied from the developing device, to a transfer sheet; and a fixing device configured to fix the transferred toner image onto the transfer sheet.

29. A photoconductor unit, in which a photoconductor is rotatably supported and a used toner collecting unit configured to collect residual used toner on the photoconductor is formed, the photoconductor unit comprising:

a narrow and long collecting inlet formed in the used toner collecting unit at a position adjacent to an outer circumferential surface of the photoconductor, the collecting inlet extending along substantially an entire length of the photoconductor;

side seals disposed at longitudinal ends of the collecting inlet so as to slidably contact an outer circumferential surface of ends of the photoconductor;

a long blade provided at one longitudinal edge of the collecting inlet so as to scrape off residual used toner on an outer circumferential surface of the photoconductor; and a long inlet seal stuck to another longitudinal edge of the collecting inlet so as to slidably contact the outer circumferential surface of the photoconductor;

wherein support parts are formed at longitudinal ends of the inlet seal protruding in a direction orthogonal to a longitudinal direction of the inlet seal to increase a sticking area of the inlet seal to the another longitudinal edge of the collecting inlet.

30. A photoconductor unit according to claim 29, wherein longitudinal ends of the inlet seal are overlaid with the side seals with respective outer edges of the inlet seal and the side seals aligned with each other, and pressing seals that are formed in a substantially L-shape with a fixing part and a leakage preventing part are disposed such that the fixing part of the pressing seals is stuck on end parts of the inlet seal and the leakage preventing part is stuck at a position to contact outer end surfaces of the side seals and the inlet seal.

31. A process cartridge, comprising a developing device, in which a developing roller is rotatably supported, and a photoconductor unit are integrated in a body, wherein the photoconductor unit includes a photoconductor rotatably supported and a used toner collecting unit to collect residual used toner on the photoconductor is formed, the photoconductor unit including, a narrow and long collecting inlet formed in the used toner collecting unit at a position adjacent to an outer circumferential surface of the photoconductor extending along substantially an entire length of the photoconductor, side seals disposed at longitudinal ends of the collecting inlet so as to slidably contact an outer circumferential surface of ends of the photoconductor, a long blade provided at one longitudinal edge of the collecting inlet so as to scrape off residual used toner on an outer circumferential surface of the photoconductor, and a long inlet seal stuck to another longitudinal edge of the collecting inlet so as to slidably contact the outer circumferential surface of the photoconductor, and wherein support parts are formed at longitudinal ends of the inlet seal protruding in a direction orthogonal to a longitudinal direction of the inlet seal to increase a sticking area of the inlet seal to the another longitudinal edge of the collecting inlet.

32. An image forming apparatus, comprising:

a process cartridge having a developing device, in which a developing roller is rotatably supported, and a photoconductor unit integrated in a body, and the photoconductor unit having a photoconductor rotatably supported therein and a used toner collecting unit to collect residual used toner on the photoconductor, the photoconductor unit including, a narrow and long collecting inlet formed in the used toner collecting unit at a position adjacent to an outer circumferential surface of the photoconductor extending along substantially an entire length of the photoconductor, side seals disposed at longitudinal ends of the collecting inlet so as to slidably contact an outer circumferential surface of ends of the photoconductor, a long blade provided at one longitudinal edge of the collecting inlet so as to scrape off residual used toner on an outer circumferential surface of the photoconductor, and a long inlet seal stuck to another longitudinal edge of the collecting inlet so as to slidably contact the outer circumferential surface of the photoconductor, and wherein support parts are formed at longitudinal ends of the inlet seal protruding in a direction orthogonal to a longitudinal direction of the inlet seal to increase a sticking area of the inlet seal to the another longitudinal edge of the collecting inlet;

a latent image forming device configured to form an electrostatic latent image on the outer circumferential surface of the photoconductor by exposing the outer circumferential surface of the photoconductor to light;

a transfer device configured to transfer the latent image on the photoconductor, which has been developed with toner supplied from the developing device, to a transfer sheet; and a fixing device configured to fix the transferred toner image onto the transfer sheet.

* * * * *